US010299610B2

(12) United States Patent
Hawkins

(10) Patent No.: US 10,299,610 B2
(45) Date of Patent: May 28, 2019

(54) MODULAR DISPLAY UNIT

(71) Applicant: Target Brands, Inc., Minneapolis, MN (US)

(72) Inventor: Laura L. Hawkins, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 38 days.

(21) Appl. No.: 15/613,552

(22) Filed: Jun. 5, 2017

(65) Prior Publication Data

US 2018/0344055 A1 Dec. 6, 2018

(51) Int. Cl.

| | |
|---|---|
| ***A47F 5/10*** | (2006.01) |
| ***E04H 3/04*** | (2006.01) |
| ***A47F 5/08*** | (2006.01) |
| *A47B 96/14* | (2006.01) |

(52) U.S. Cl.
CPC ..... *A47F 5/0815* (2013.01); *A47F 5/0846* (2013.01); *A47B 96/1416* (2013.01)

(58) Field of Classification Search
CPC .. A47F 5/10; A47F 5/08; A47F 5/0815; A47F 7/00; A47F 7/16; A47F 5/105
See application file for complete search history.

(56) References Cited

U.S. PATENT DOCUMENTS

| | | | | |
|---|---|---|---|---|
| 1,392,418 | A | | 10/1921 | Hill |
| 1,461,374 | A | | 7/1923 | Anderson |
| 1,510,435 | A | | 9/1924 | Trapp |
| 1,752,369 | A | | 4/1930 | Chapman |
| 2,150,743 | A | | 3/1939 | Mancuso |
| 2,285,962 | A | | 6/1942 | Foulkes |
| 2,291,265 | A | | 7/1942 | Viglietta |
| 2,477,761 | A | | 8/1949 | Messerschmidt |
| 2,496,221 | A | | 1/1950 | Koch |
| 2,554,610 | A | | 5/1951 | Benson |
| 3,164,350 | A | | 1/1965 | Taub |
| 3,174,629 | A | * | 3/1965 | Gelberg ..... A47F 5/105 108/11 |
| 3,186,781 | A | * | 6/1965 | Lax ..... A47F 5/105 312/200 |
| 3,202,469 | A | * | 8/1965 | Lawe ..... G09F 5/02 312/200 |
| 3,433,365 | A | | 3/1969 | Hodson |
| 3,598,246 | A | | 8/1971 | Galli |
| 4,288,948 | A | * | 9/1981 | Harris ..... E04H 3/04 52/28 |
| 4,319,688 | A | * | 3/1982 | Wahl ..... A47F 5/00 211/175 |

(Continued)

*Primary Examiner* — Kimberley S Wright
(74) *Attorney, Agent, or Firm* — Leanne Taveggia Farrell; Westman, Champlin & Koehler, P.A.

(57) ABSTRACT

A modular display unit includes a platform that occupies a rectangular footprint and includes opposing ends being substantially parallel to each other. The modular display unit also includes at least one wall that extends upwardly from the platform. The at least one wall has a first outer panel including a planar top end, a bottom end and a pair of side ends, a second outer panel having a planar top end, a bottom end and a pair of side ends, and an inner panel positioned between the first outer panel and the second outer panel and including a top end, a bottom end and a pair of side ends.

20 Claims, 21 Drawing Sheets

(56) References Cited

U.S. PATENT DOCUMENTS 4,360,240 A * 11/1982 Koncelik ..... A47B 81/00 108/59
4,428,136 A * 1/1984 Franklin ..... A47F 11/00 211/175
4,561,550 A * 12/1985 Franklin ..... A47F 5/0815 211/175
5,013,100 A * 5/1991 Zich ..... A47B 46/00 108/64
5,370,249 A * 12/1994 Harvey ..... A47B 57/42 211/189
5,588,541 A * 12/1996 Goetz ..... A47B 87/008 211/186
5,620,103 A * 4/1997 Vlah ..... A47F 5/105 211/175
5,620,104 A 4/1997 Maglione
5,690,239 A * 11/1997 Ballard ..... A47F 5/04 211/187
5,762,207 A 6/1998 Maglione
6,062,402 A * 5/2000 Ford ..... A47F 5/083 211/181.1
6,375,285 B1 4/2002 Choi
6,427,857 B1 * 8/2002 Adams ..... A47F 5/10 211/162
6,488,200 B1 12/2002 Jensen, Jr.
6,715,308 B2 4/2004 Grimm et al.
6,935,523 B2 8/2005 Ahn
7,234,604 B2 * 6/2007 Eisele ..... A47B 57/42 108/65
8,752,718 B2 * 6/2014 Stukenberg ..... A47G 25/0664 211/87.01
8,789,899 B2 7/2014 Pirro et al.
8,820,481 B2 9/2014 Brucia
9,414,696 B2 8/2016 Brucia
2005/0230338 A1 * 10/2005 Farinola ..... A47F 5/0838 211/186
2005/0252872 A1 * 11/2005 Eisele ..... A47B 57/42 211/187
2013/0220947 A1 * 8/2013 Pintur ..... A47F 5/0018 211/1
2013/0284684 A1 * 10/2013 Stukenberg ..... A47G 25/0664 211/59.2

* cited by examiner

MODULAR DISPLAY UNIT

BACKGROUND

Retail stores use a variety of display fixtures to present products to customers for purchase. These display fixtures can support the product, indicate the product price, include signage for highlighting the product and/or include structures that hold samples of the product. Exemplary display structures include shelves, trays, racks, peg hooks and other similar structures.

The discussion above is merely provided for general background information and is not intended to be used as an aid in determining the scope of the claimed subject matter.

SUMMARY

A modular display unit includes a plurality of adjacent base components including two endcap base components and at least one v-shaped base component located between the two endcap base components. The plurality of adjacent base components occupy a space defined between outer ends of the two endcap base components that are substantially parallel to each other. At least two angled walls extend upwardly from the plurality of adjacent base components. Each angled wall is oriented at an angle relative to the substantially parallel outer ends of the two endcap base components, have a side that is adjacent to a side of another angled wall and are oriented perpendicularly to each other. A number of v-shaped base components in modular display unit is one less than a number of the at least two angled walls.

A modular display unit includes a platform that includes opposing ends that are substantially parallel to each other. At least one wall extends upwardly from the platform and includes a first outer panel having at least one opening with a length and a width, a second outer panel having at least one opening that aligns with the at least one opening in the first outer panel and having a length and a width that is the same as the length and the width of the at least one opening in the first outer panel and an inner panel positioned between the first outer panel and the second outer panel and including at least one opening that aligns with the at least one opening in the first outer panel and the at least one opening in the second outer panel. The at least one opening in the inner panel has a length and a width that is greater than the lengths and the widths of the at least one opening in the first outer panel and the at least one opening in the second outer panel so that at least a bottom of the at least one opening in the inner panel is recessed from a bottom of the at least one opening in the first outer panel and a bottom of the at least one opening in the second outer panel.

A modular display unit includes a platform that includes opposing ends that are substantially parallel to each other and at least one wall that extends upwardly from the platform. Each wall includes a first outer panel having a planar top end, a bottom end and a pair of side ends, a second outer panel having a planar top end, a bottom end and a pair of side ends and an inner panel positioned between the first outer panel and the second outer panel and having a top end, a bottom end and a pair of side ends. The top end includes a pair of planar upper portions and a planar middle portion located between the pair of planar upper portions that is recessed from the pair of planar upper portions. The planar top ends of the first outer panel and the second outer panel align with the pair of planar upper portions of the top end of the inner panel.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Embodiments of a modular display unit that is composed of standardized components or sections for easy construction and flexible arrangement include opposing ends being substantially parallel to each other. The modular display unit also includes at least one wall that extends upwardly from the platform. In general, the modular display unit includes two walls that are angled relative to the opposing ends of the platform and are adjacent to each other and oriented substantially perpendicular to each other in order to give a customer the feel of a bazaar stall type shopping experience. However, to open the field of view, the walls of the display unit have openings or windows so that the customer can see through to products that are displayed on an opposing side of the walls. In particular, display hooks can be hung from the openings so that a customer can not only view the products hanging on their side of the wall, but also see products hanging on the other side of the wall. Still further, the modular display unit, with a base-type platform, include modular base components so that the unit can be easily lengthened and reconfigured to add a series of additional angled walls.

Figure 1:
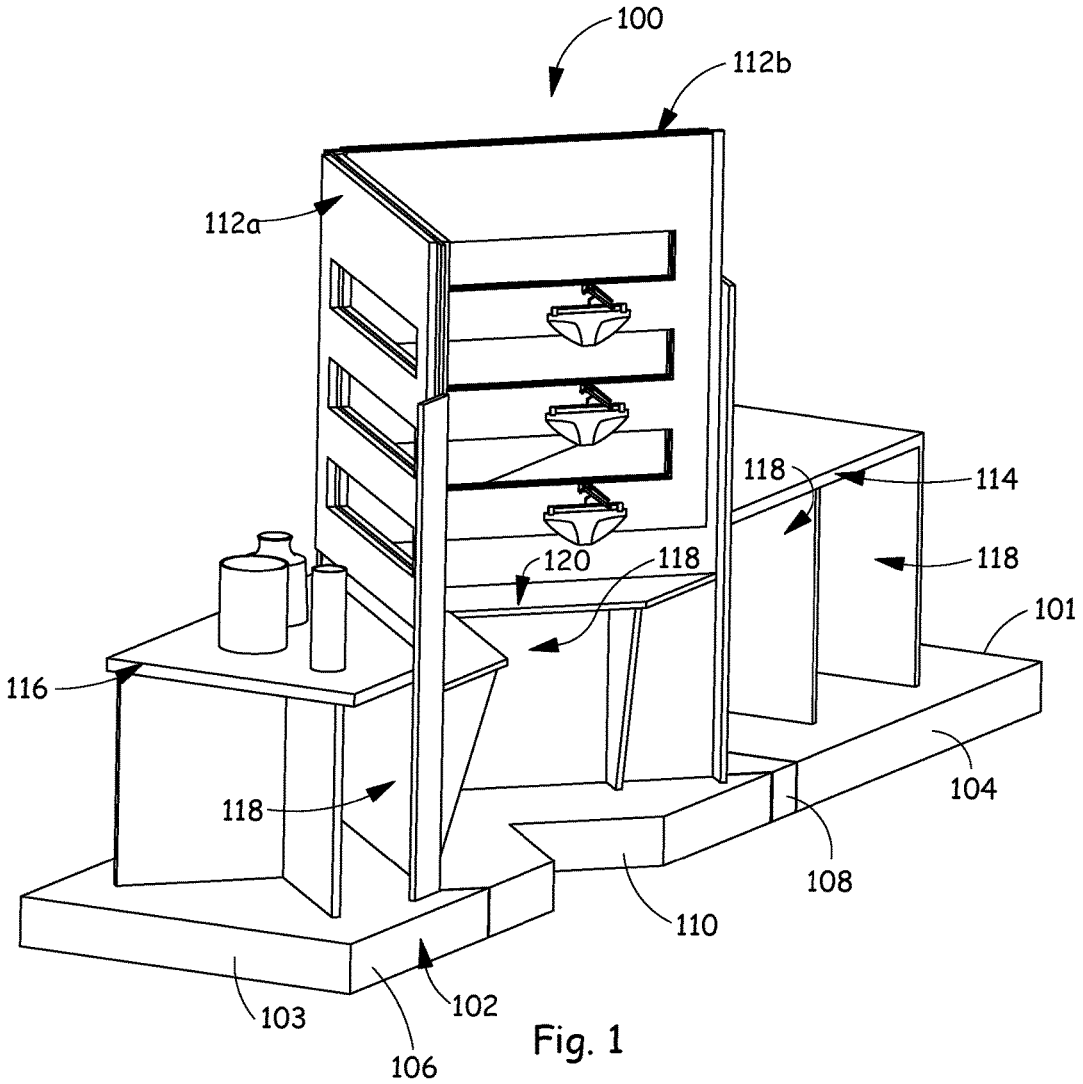
FIG. 1 is a perspective view of a modular display unit according to one embodiment.
Figure 2:
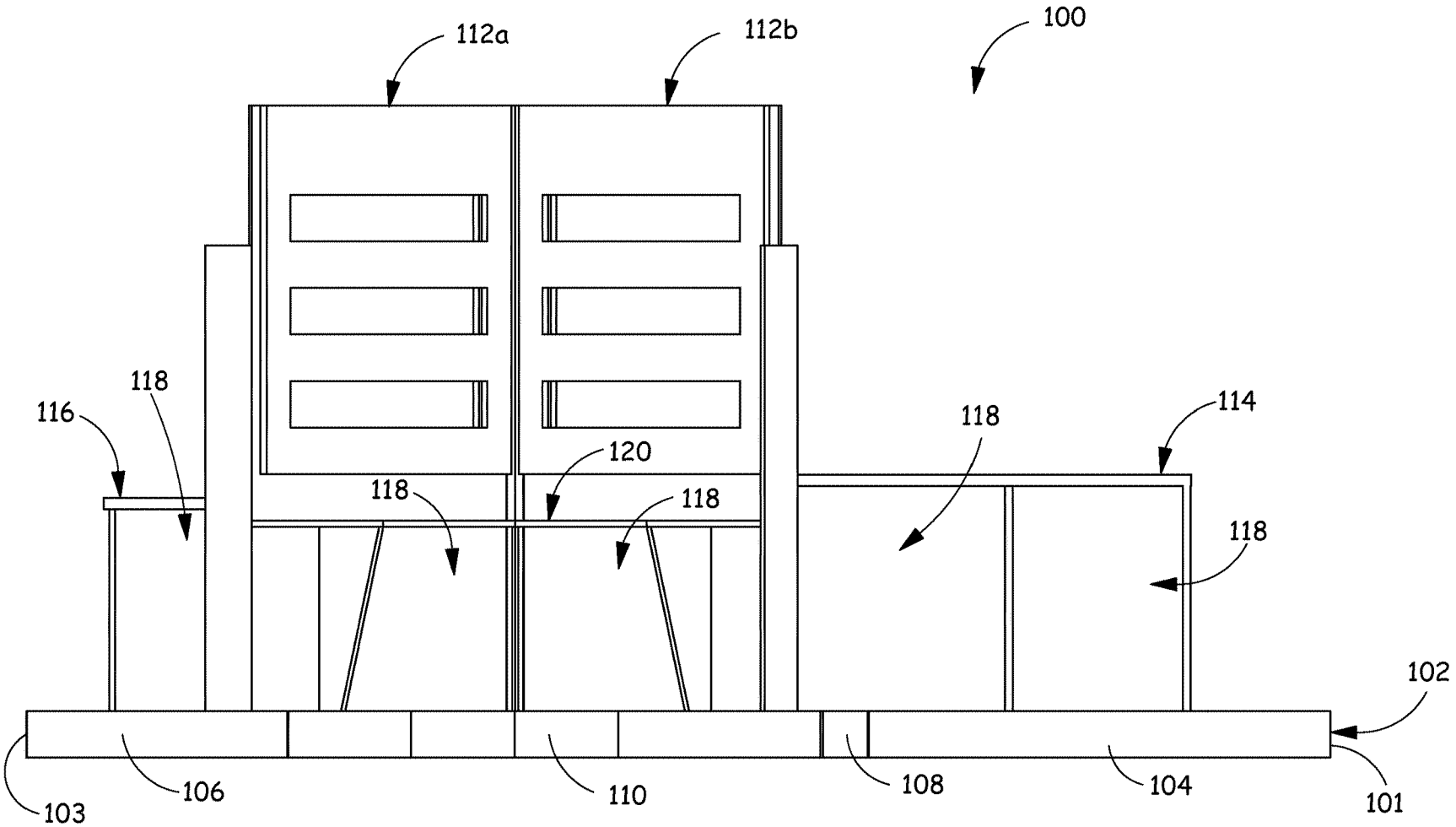
FIG. 2 is a left side view of the modular display unit of FIG. 1.
Figure 3:
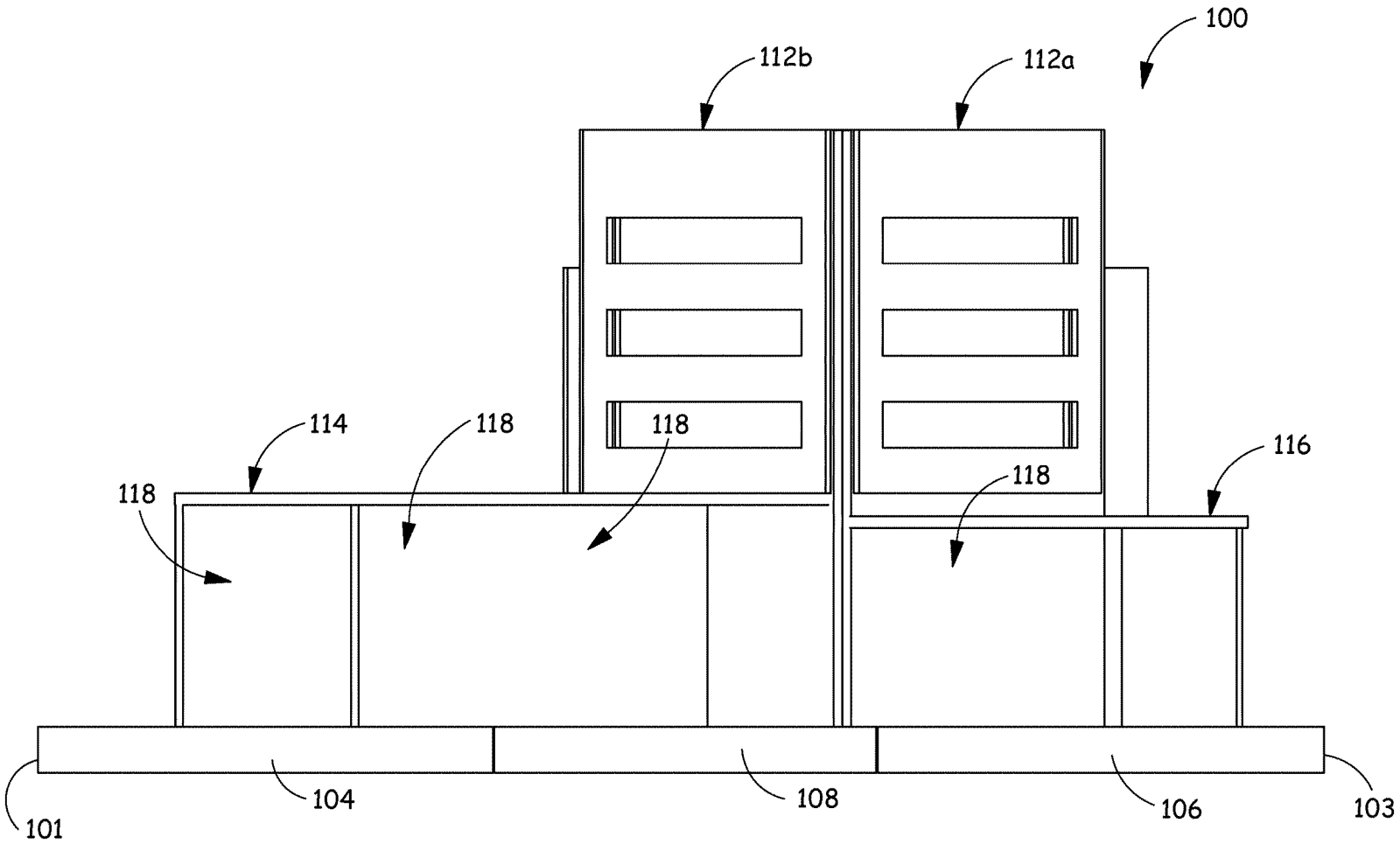
FIG. 3 is a right side view of the modular display unit of FIG. 1.
Figure 4:
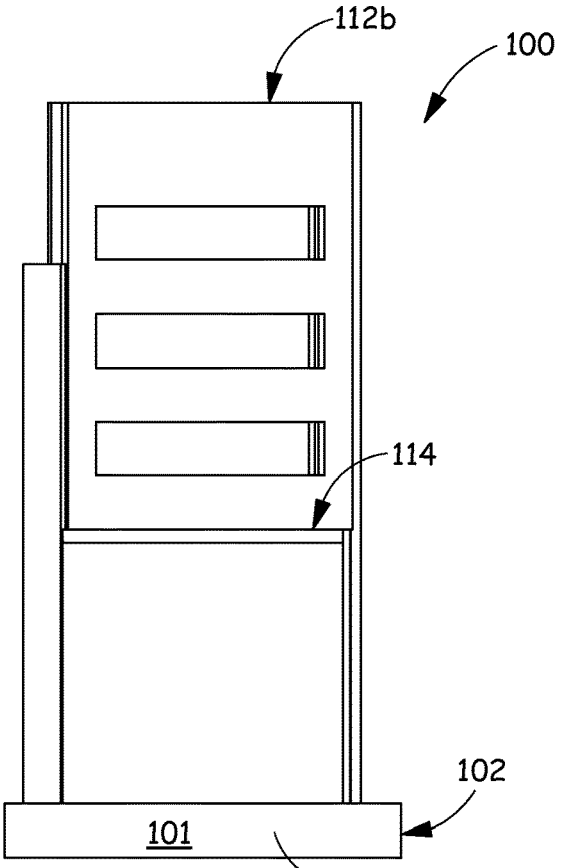
FIG. 4 a front view of the modular display unit of FIG. 1.
Figure 5:
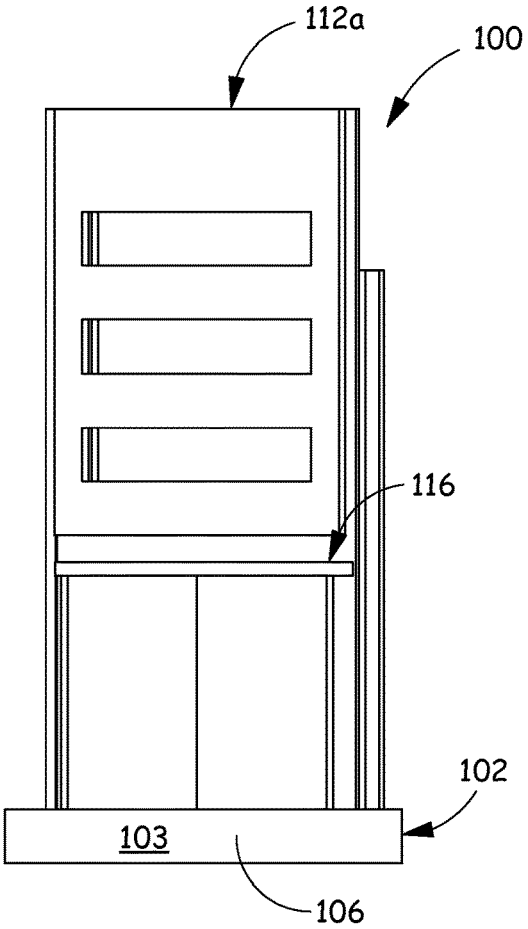
FIG. 5 is a back view of the modular display unit of FIG. 1.
Figure 6:
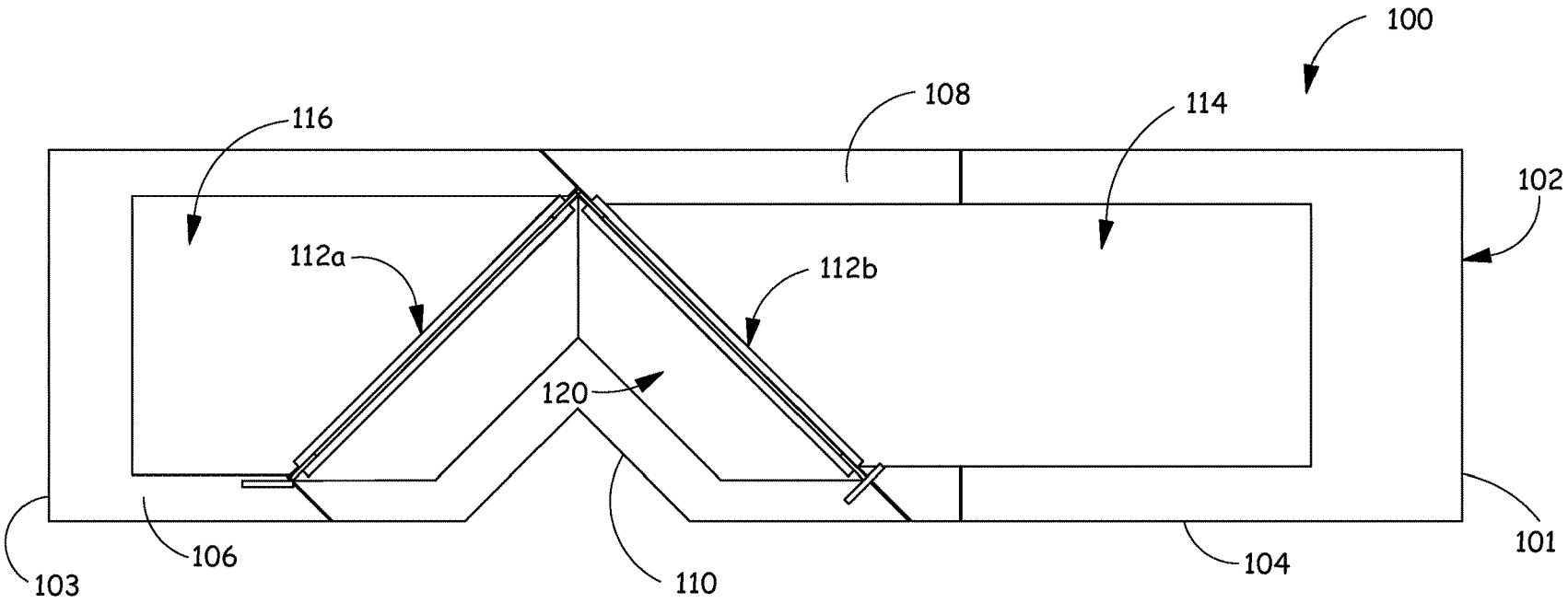
FIG. 6 is a top view of the modular display unit of FIG. 1.

FIG. 1 is a perspective view of a modular display unit 100 according to one embodiment. FIG. 1 illustrates exemplary products on display. FIG. 2 is a left side view, FIG. 3 is a right side view, FIG. 4 is a front view, FIG. 5 is a back view and FIG. 6 is a top view of modular display unit 100. FIGS. 2-6 remove the exemplary products on display for purposes of clearly illustrating modular display unit 100. Modular display unit 100 is a base type display unit including platform or base 102 that occupies a space defined between opposing outer ends 101 and 103 of platform 102 that are substantially parallel to each other. Modular display unit 100 also includes angled walls 112*a* and 112*b* that extend upwardly from platform 102, tables 114 and 116, cubbies 118 and shelving 120 all supported by platform 102. Platform 102 includes multiple adjacent base components including a front base or endcap base 104, a back base or endcap base 106, a middle base 108 and a v-shaped base 110. These bases are modular in that the base components are composed of standardized sections that can be duplicated, removed and/or added in order to reconfigure modular display unit 100 to include more angled walls and therefore more cubbies 118 and shelving 120. Base components 104, 106, 108 and 110 will be discussed in more detail below.

Figure 7:
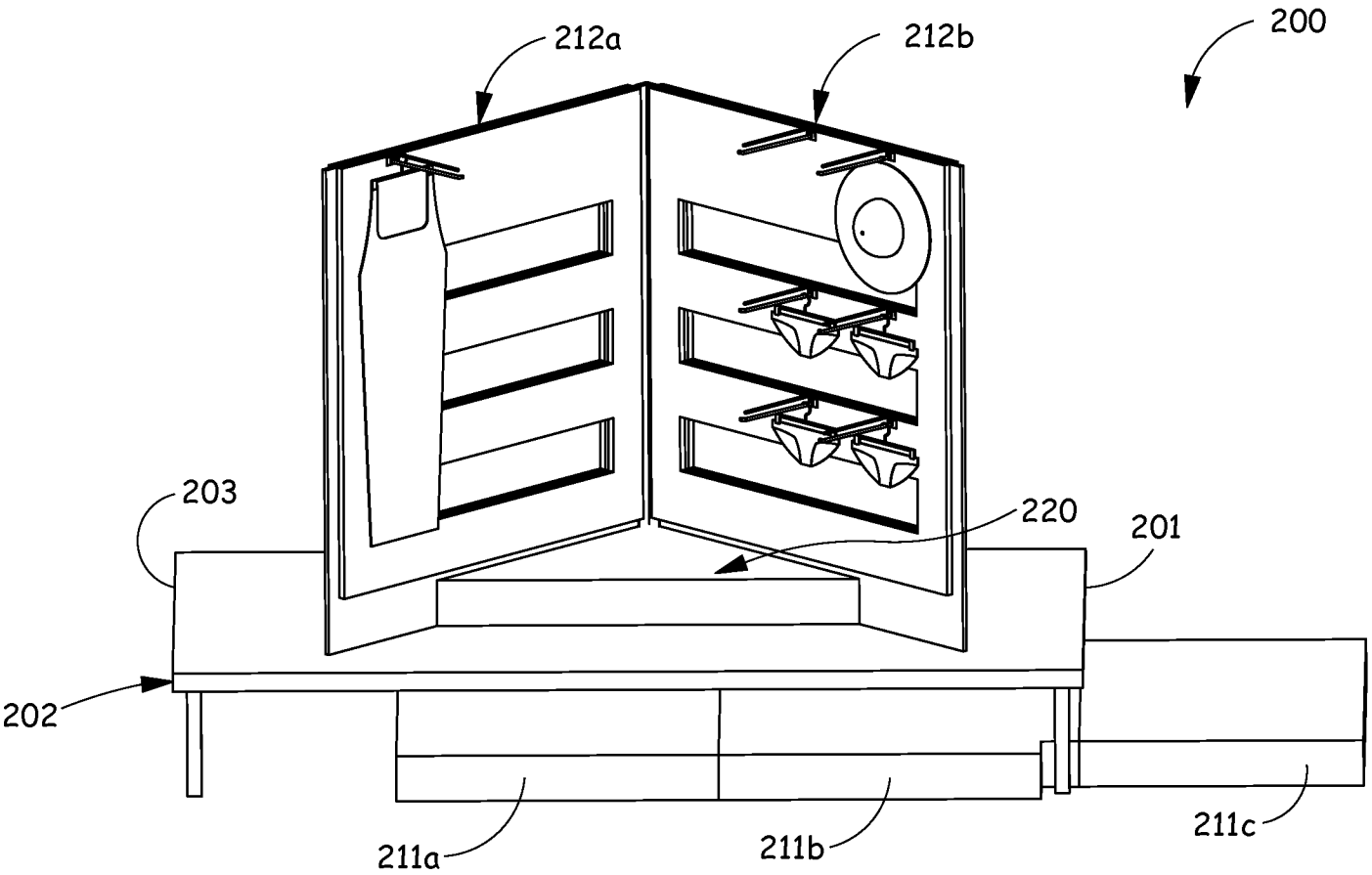
FIG. 7 is a perspective view of a modular display unit according to another embodiment.
Figure 8:
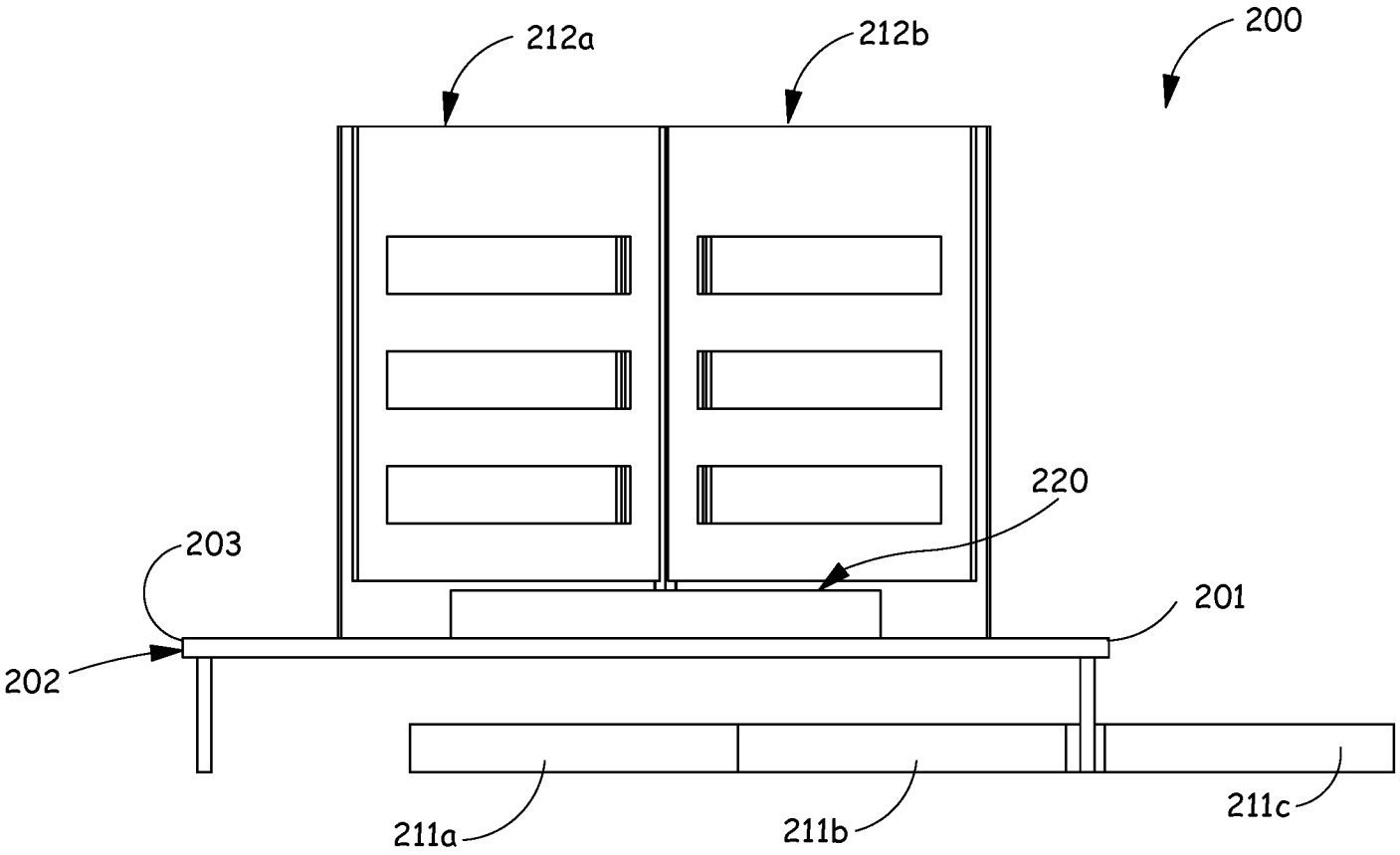
FIG. 8 is a left side view of the modular display unit of FIG. 7.
Figure 9:
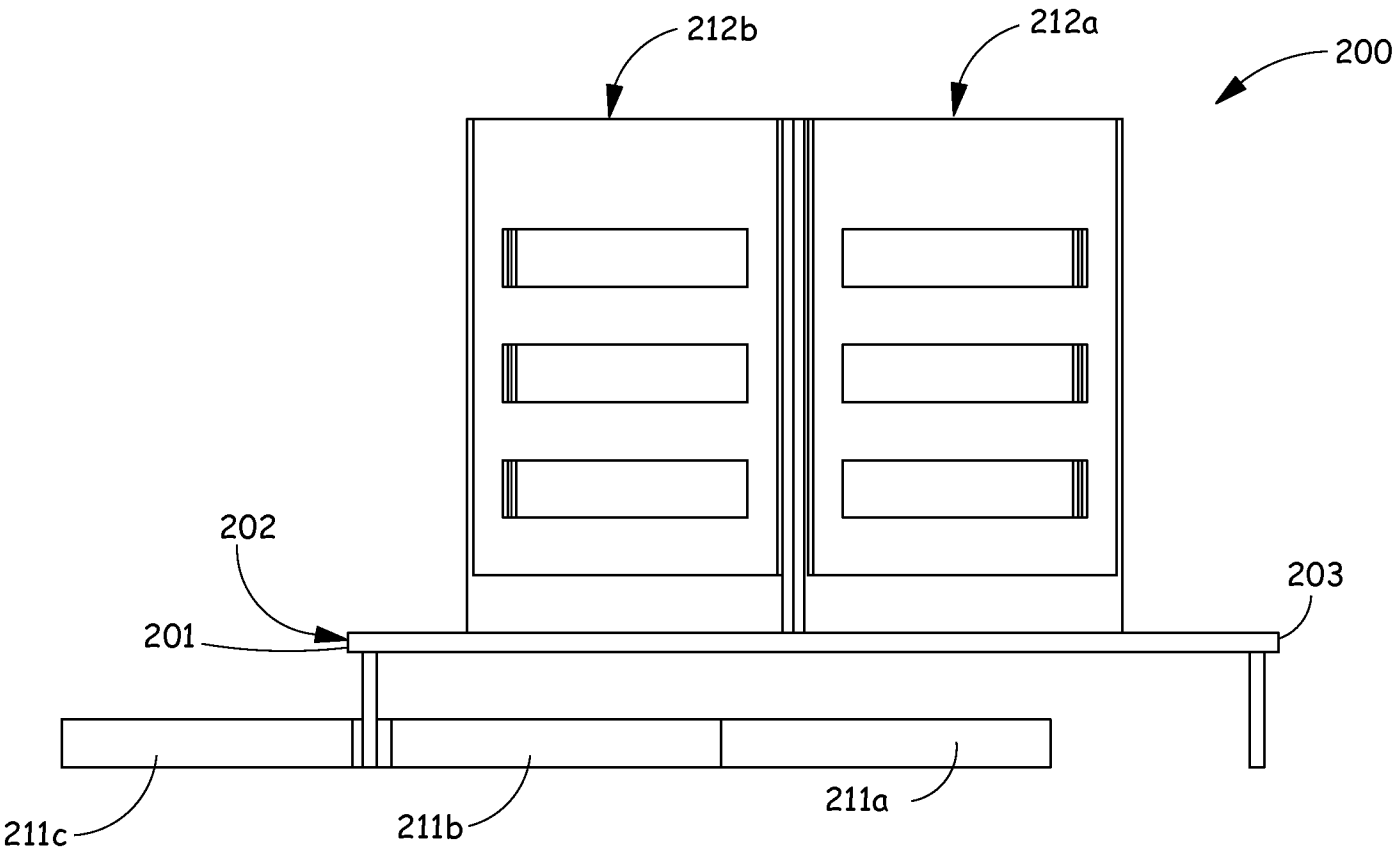
FIG. 9 is a right side view of the modular display unit of FIG. 7.
Figure 10:
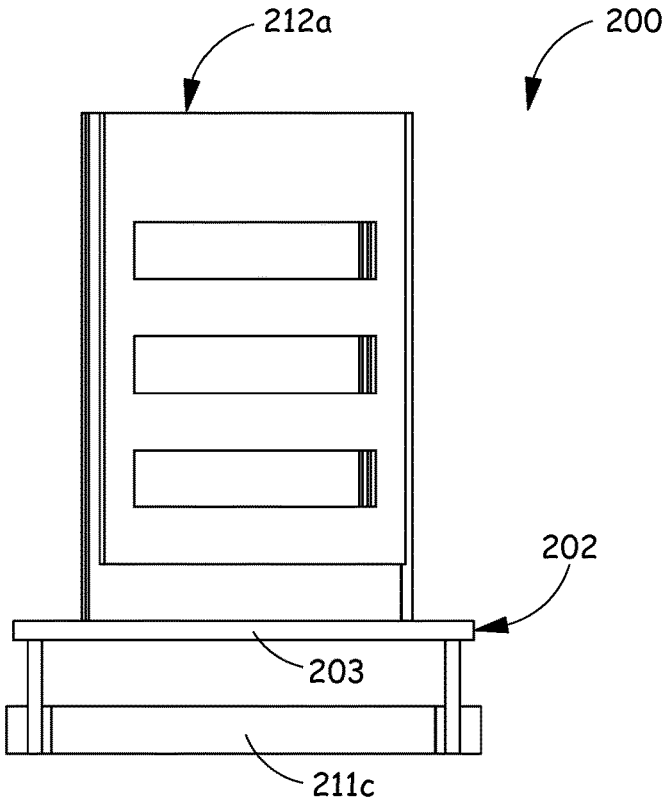
FIG. 10 a front view of the modular display unit of FIG. 7.
Figure 11:
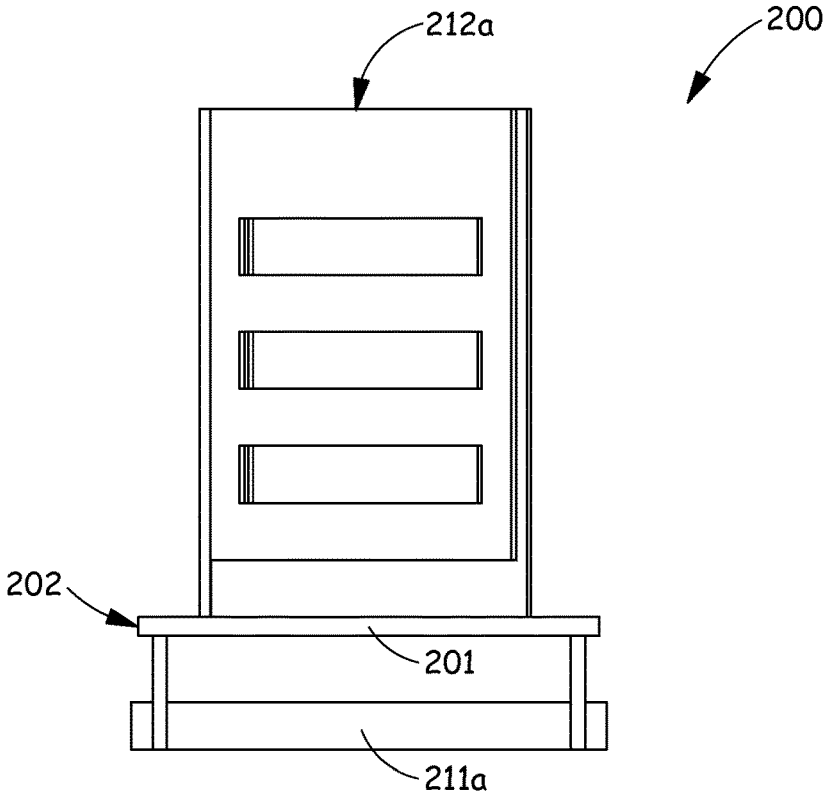
FIG. 11 is a back view of the modular display unit of FIG. 7.
Figure 12:
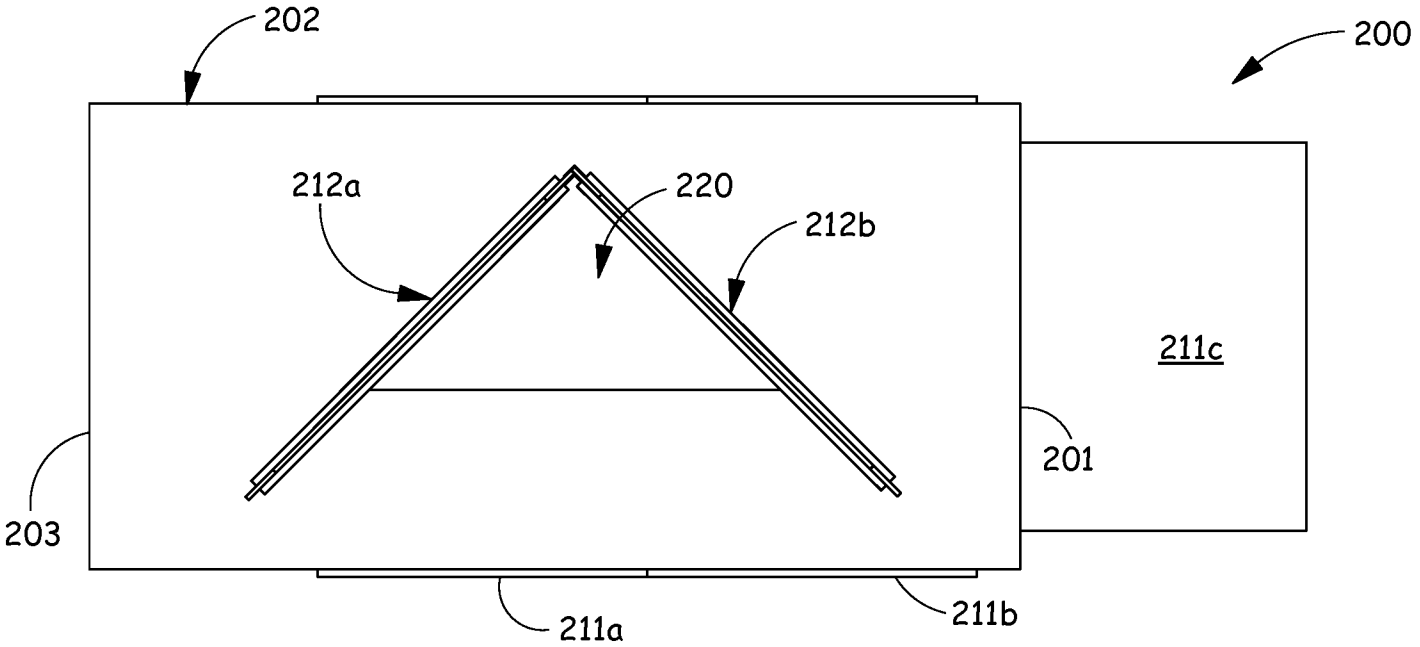
FIG. 12 is a top view of the modular display unit of FIG. 7.

FIG. 7 is a perspective view of a modular display unit 200 according to another embodiment. FIG. 7 illustrates exemplary products on display. FIG. 8 is a left side view, FIG. 9 is a right side view, FIG. 10 is a front view, FIG. 11 is a back view and FIG. 12 is a top view of modular display unit 200. FIGS. 8-12 remove the exemplary products on display for purposes of clearly illustrating modular display unit 200. Like modular display unit 100, modular display unit 200 includes a platform 202 having opposing outer ends 201 and 203 that are substantially parallel to each other, angled walls 212*a* and 212*b* that extend upwardly from platform 202 and shelving 220. Unlike modular display 100, modular display unit 200 is a table type display unit where platform 202 is a table that supports the above-listed components. It should be pointed out that modular display unit 200 includes a plurality of adjacent base components 211*a*, 211*b* and 211*c*. However, base components 211*a*, 211*b* and 211*c* are for purposes of supporting product or providing aesthetics for display unit 200 and not for supporting angled walls 212*a* and 212*b*.

Figure 13:
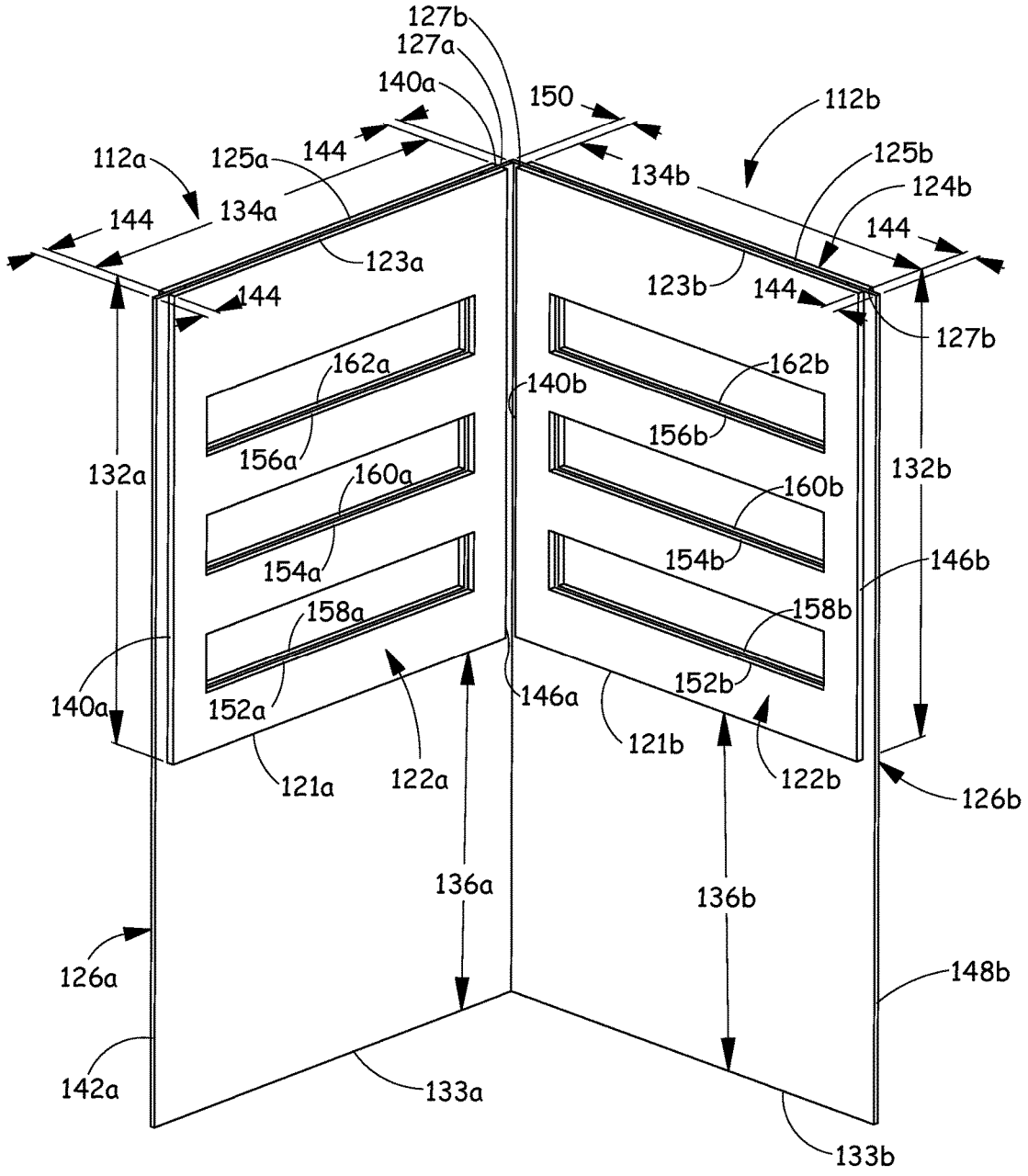
FIG. 13 is a first perspective view of two angled walls of the modular display unit illustrated in FIGS. 1-6.
Figure 14:
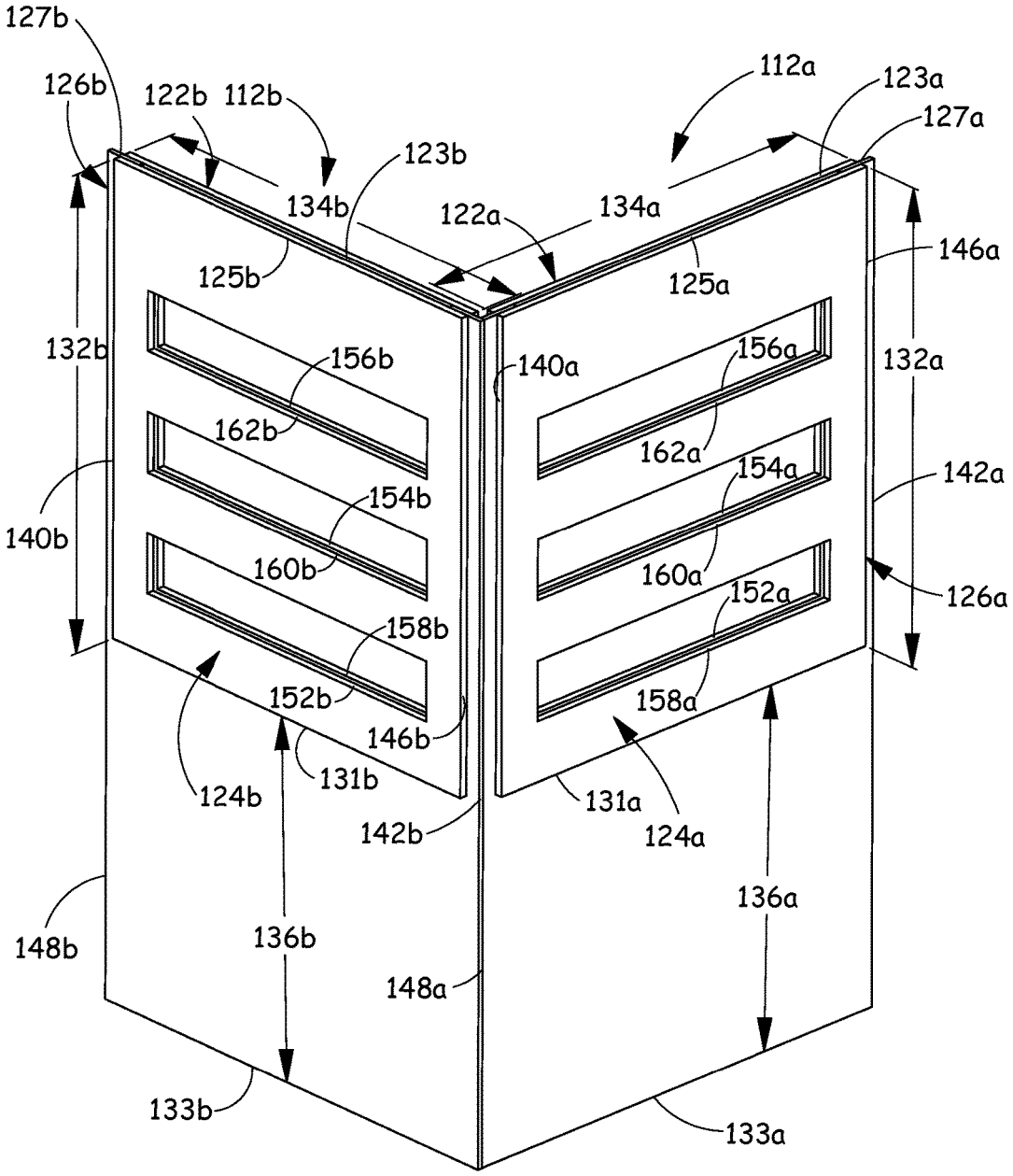
FIG. 14 is a second perspective view of the two angled walls of the modular display unit illustrated in FIGS. 1-6

FIG. 13 is a first perspective view of two angled walls 112*a* and 112*b* of modular display unit 100 and FIG. 14 is a second perspective view of FIG. 13. Each of angled walls 112*a* and 112*b* include three layers. Left angled wall 112*a* includes two substantially identical outer panels 122*a* and 124*a* and a single inner panel 126*a* positioned between first outer panel 122*a* and second outer panel 124*a*. Right angled wall 112*b* also includes two substantially identical outer panels 122*b* and 124*b* and a single inner panel 126*b* positioned between first outer panel 122*b* and second outer panel 124*b*. An example material for the panels of walls 112*a* and 112*b* include cardboard and more specifically a corrugated cardboard with high strength such as Falconboard®, which is a paper-based backing board product produced and sold by Packaging Corporation of America of Lake Forest, Ill. Other high strength materials for constructing the panels are also possible like, for example, metal or wood based products.

Figure 15:
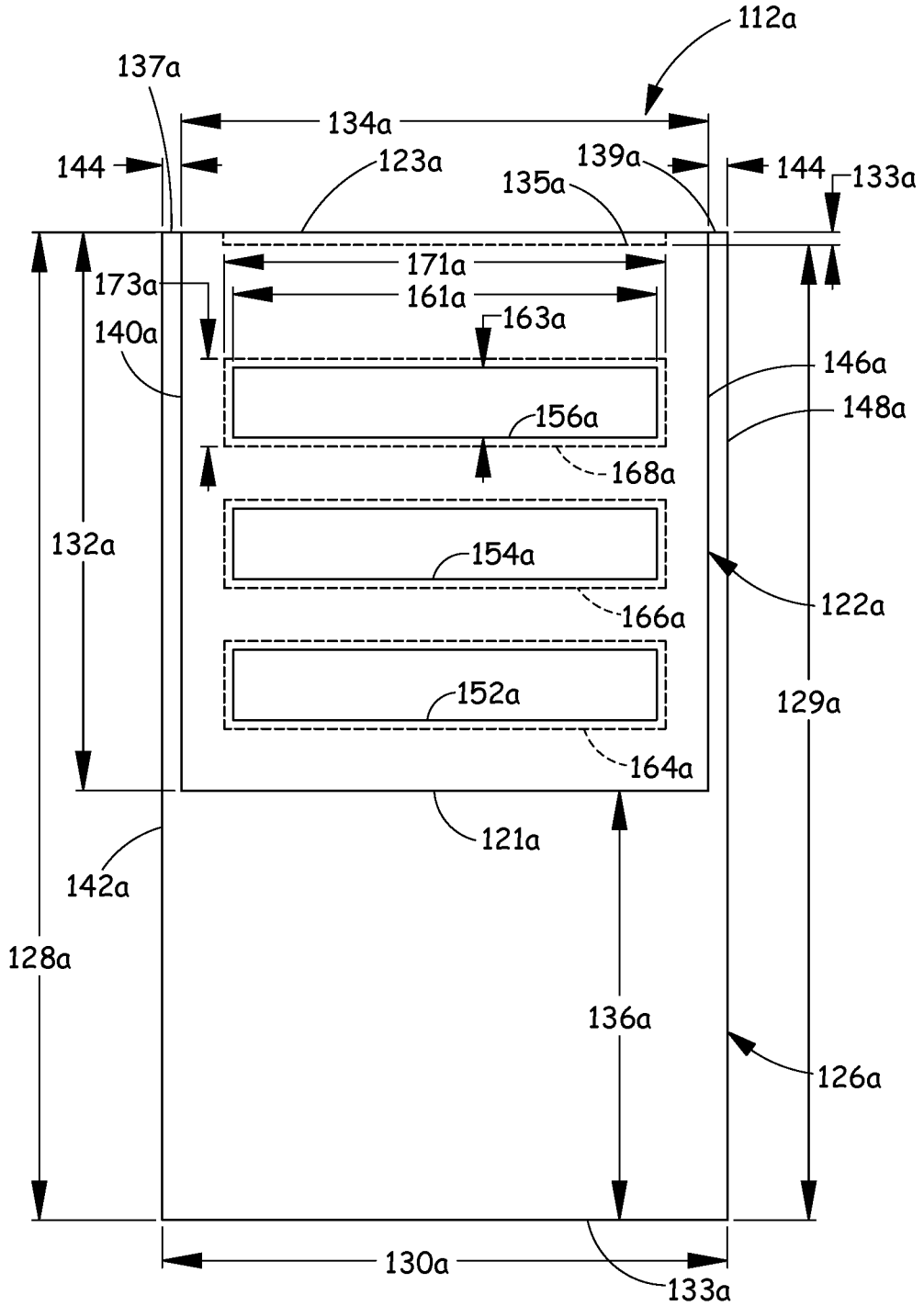
FIG. 15 is a plan view of the left angled wall of FIGS. 13 and 14.
Figure 16:
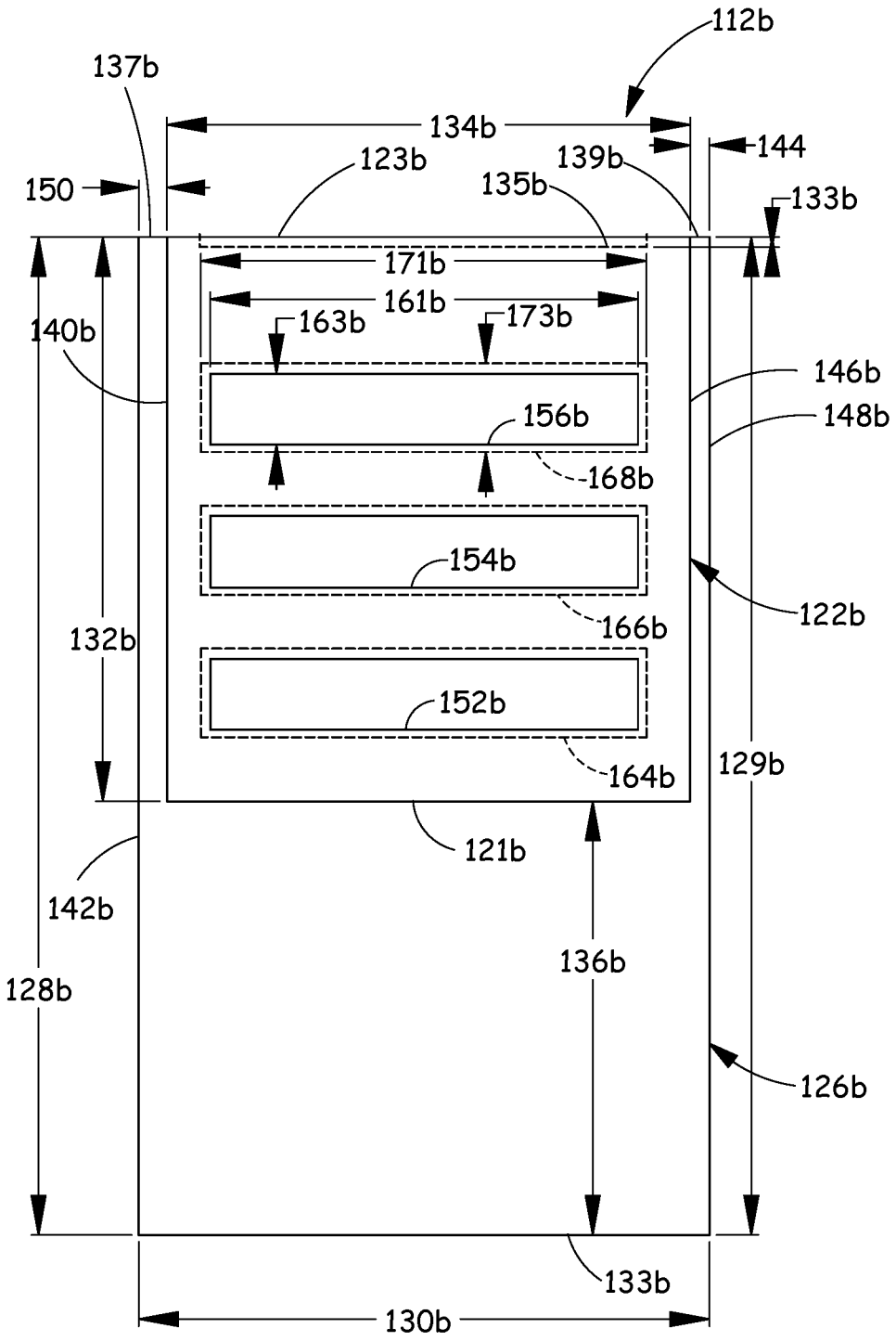
FIG. 16 is a plan view of the right angled wall of FIGS. 13 and 14.
Figure 17:
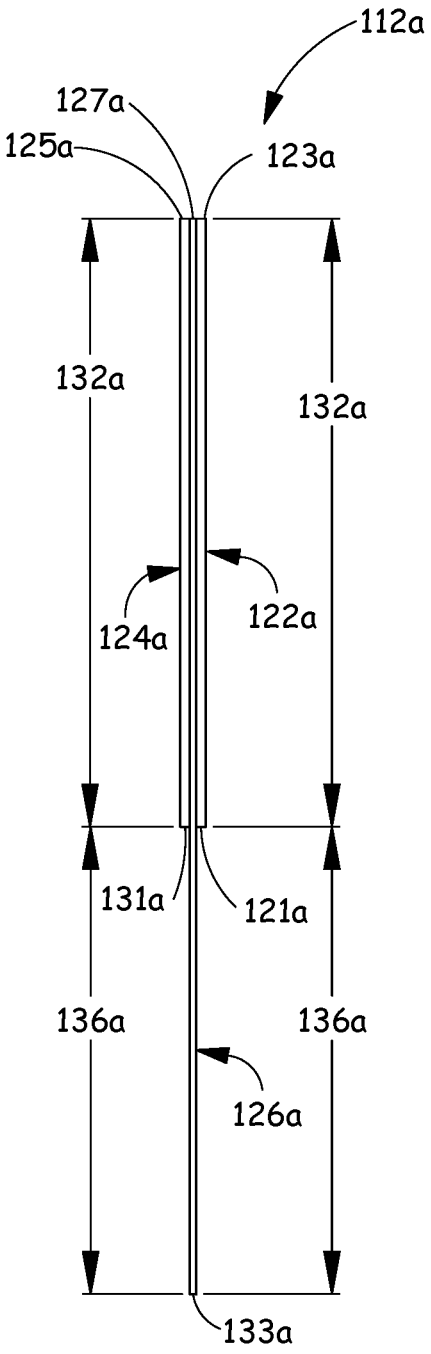
FIG. 17 is a left side view of the left angled wall of FIG. 15.

FIG. 15 is a plan view of left angled wall 112*a*, FIG. 16 is a plan view of right angled wall 112*b* and FIG. 17 is a left side view of left angled wall 112*a*, which is substantially identical to a left side view of right angled wall 112*b*. As previously discussed, left angled wall 112*a* includes first outer panel 122*a*, second outer panel 124*a* (not shown in FIG. 15) and inner panel 126*a* and right angled wall 112*b* includes first outer panel 122*b*, second outer panel 124*b* (not shown in FIG. 16) and inner panel 126*b*. In the embodiment illustrated in FIGS. 13-17, each panel 122*a*, 122*b*, 124*a*, 124*b*, 126*a* and 126*b* is made of material that can be but is not limited to being of substantially the same thickness and each panel 122*a*, 122*b*, 124*a*, 124*b*, 126*a* and 126*b* includes three windows or openings. However, in other embodiments, the dimensions of, the number of and the type of openings varies.

As shown in the embodiment illustrated in FIGS. 13-17, inner panels 126*a* and 126*b* have respective first heights 128*a* and 128*b* and respective widths 130*a* and 130*b* (FIGS. 15 and 16). Respective first heights 128*a* and 128*b* of inner panels 126*a* and 126*b* are not continuous across the entire width of inner panels 126*a* and 126*b* and rather each inner panel 126*a* and 126*b* includes a second height 129*a* and 129*b*, respectively. In other words, respective top ends 127*a* and 127*b* of inner panels 126*a* and 126*b* are not all located along a single plane. A middle portion 135*a* of top end 127*a* is located a distance 133*a* below two end portions 137*a* and 139*a* of top end 127, and a middle portion 135*b* of top end 127*b* is located a distance 133*b* below two end portions 137*b* an 139*b* of top end 127*b*.

Each of first and second outer panels 122*a* and 124*a* of left angled wall 112*a* has substantially the same height 132*a* (FIGS. 13, 14, 15 and 17) and each of first and second outer panels 122*b* and 124*b* of right angled wall 112*b* has substantially the same height 132*b* (FIGS. 13, 14 and 16). Each of first and second outer panels 122*a* and 124*a* of left angled wall 112*a* has substantially the same widths 134*a* (FIGS. 13, 14 and 15) and each of first and second outer panels 122*b* and 124*b* of right angled wall 112*b* has substantially the same widths 134*b* (FIGS. 13, 14 and 16).

While all panels 122*a*, 124*a* and 126*a* of left angled wall 112*a* have respective top ends 123*a*, 125*a* and 127*a* that align as illustrated in FIGS. 13-17, first height 128*a* of inner panel 126*a* is greater than heights 132*a* of outer panels 122*a* and 124*a*. Therefore, respective bottom ends 121*a* and 131*a* of outer panels 122*a* and 124*a* are spaced apart from a bottom end 133*a* of inner panel 126*a* by substantially the same distances 136*a*. In addition, while all panels 122*a*, 124*a* and 126*a* have top ends 123*a*, 125*a* and 127*a* (planar top end 123*a*, planar top end 125*a* and planar upper portions of top end 127*a*) that align as illustrated in FIGS. 13-17, none of the other ends or sides of outer panels 122*a* and 124*a* or inner panel 126*a* are in alignment. In particular, width 130*a* of inner panel 126*a* is greater than widths 134*a* of outer panels 122*a* and 124*a*.

While all panels 122*b*, 124*b* and 126*b* of right angled wall 112*b* have respective top ends 123*b*, 125*b* and 127*b* that align as illustrated in FIGS. 13-17, first height 128*b* of inner panel 126*b* is greater than heights 132*b* of outer panels 122*b* and 124*b*. Therefore, respective bottom ends 121*b* and 131*b* of outer panels 122*b* and 124*b* are spaced apart from a bottom end 133*b* of inner panel 126*b* by substantially the same distances 136*b*. In addition, while all panels 122*b*, 124*b* and 126*b* have top ends 123*b*, 125*b* and 127*b* (planar top end 123*b*, planar top end 125*b* and planar upper portions of top end 127*b*) that align as illustrated in FIGS. 13-17, none of the other ends or sides of outer panels 122*b* and 124*b* or inner panel 126*b* are in alignment. In particular, width 130*b* of inner panel 126*b* is greater than widths 134*b* of outer panels 122*b* and 124*b*.

In regards to left angled wall 112*a*, a left side 140*a* of first outer panel 122*a* as viewed from the front view illustrated in FIGS. 13 and 15 is spaced apart from a left side 142*a* of inner panel 126*a* by a distance 144. Directly opposite from and as viewed from the back view illustrated in FIG. 14, a right side 146*a* of second outer panel 124*a* is spaced apart from left side 142*a* of inner panel 126*a* by substantially the same distance 144. In addition, a right side 146*a* of first outer panel 122*a* as viewed from the front view illustrated in FIGS. 13 and 15 is spaced apart from a right side 148*a* of inner panel 126*a* by substantially the same distance 144. Directly opposite from and as viewed from the back view illustrated in FIG. 14, a left side 140*a* of second outer panel 124*a* is spaced apart from right side 148*a* of inner panel 126*a* by substantially the same distance 144.

In regards to right angled wall 112*b*, a left side 140*b* of first outer panel 122*b* as viewed from the front view illustrated in FIGS. 13 and 16 is spaced apart from a left side 142*b* of inner panel 126*b* by a distance 150. Directly opposite from and as viewed from the back view illustrated in FIG. 14, a right side 146*b* of second outer panel 124*b* is spaced apart from left side 142*b* of inner panel 126*b* by substantially the same distance 150. Distance 150 is greater than distance 144. In addition, a right side 146*b* of first outer panel 122*b* as viewed from the front view illustrated in FIGS. 13 and 16 is spaced apart from a right side 148*b* of inner panel 126*b* by distance 144, which is substantially the same distance as the distances between the sides of first outer panel 122*a* and second outer panel 124*a* and the sides of inner panel 126*a*. Directly opposite from and as viewed from the back view illustrated in FIG. 14, a left side 140*b* of second outer panel 124*b* is spaced apart from right side 148*b* of inner panel 126*b* by substantially the same distance 144.

Distance 150 is greater than distance 144 so that it is possible to place a thickness of right side 148*a* of inner panel 126*a* flush against the portion of the inner panel 126*b* that includes distance 150 with edges aligned as illustrated in FIGS. 13 and 14. In this way, more walls can be placed adjacent to angled walls 112*a* and 112*b* to form, for example, a three-legged wall, a four-legged wall in the shape of a "w" and more legs as desired. When adding any additional legs to form a multi-legged wall, a right angled wall 112*b* would need to be added for each leg in order for the edges to align properly. These configurations will be discussed and shown in more detail below.

As previously described, each angled wall 112*a* and 112*b* further includes a plurality of openings. In the embodiment illustrated in FIGS. 13-17, each angled wall 112*a* and 112*b* includes three openings. These three openings in each angled wall 112*a* and 112*b* comprise three openings in each of the three layers of material that comprise each angled wall 112*a* and 112*b*. Left angled wall 112*a* includes three openings 152*a*, 154*a* and 156*a* in first outer panel 122*a* and three openings 158*a*, 160*a* and 162*a* in second outer panel 124*a*. Opening 152*a* of panel 122*a* is in alignment with opening 158*a* of panel 124*a*, opening 154*a* is in alignment with opening 160*a* in panel 124*a* and opening 156*a* of panel 122*a* is in alignment with opening 162*a* in panel 124*a*. In other words, openings 152*a*, 154*a*, 156*a* in first outer panel 122*a* and openings 158*a*, 160*a* and 162*a* in second outer panel 124*a* have substantially the same dimensions including a length 161*a* and a height 163*a* (FIG. 15).

There are also three openings 164*a*, 166*a* and 168*a* in inner panel 126*a* as shown in phantom lines in FIG. 15. Openings 164*a*, 166*a* and 168*a* all have substantially the same length 171*a* and height 173*a* and length 171*a* is greater than length 161*a* and height 173*a* is greater than height 163*a*. This means that the perimeter of opening 164*a* in inner panel 126*a* is recessed from the aligned perimeters of openings 152*a* and 158*a*, the perimeter of opening 166*a* in inner panel 126*a* is recessed from the aligned perimeters of openings 154*a* and 160*a* and the perimeter of opening 168*a* in inner panel 126*a* is recessed from the aligned perimeters of openings 156*a* and 162*a*. In other embodiments, at least a bottom of opening 164*a* in inner panel 126*a* is recessed from bottoms of openings 152*a* and 158*a*, a bottom of opening 166*a* in inner panel 126*a* is recessed from bottoms of openings 154*a* and 160*a* and a bottom of opening 168*a* in inner panel 126*a* is recessed from bottoms of openings 156*a* and 162*a*.

Right angled wall 112*b* includes three openings 152*b*, 154*b* and 156*b* in first outer panel 122*b* and three openings 158*b*, 160*b* and 162*b* in second outer panel 124*b*. Opening 152*b* of panel 122*b* is in alignment with opening 158*b* of panel 124*b*, opening 154*b* is in alignment with opening 160*b* in panel 124*b* and opening 156*b* of panel 122*b* is in alignment with opening 162*b* in panel 124*b*. In other words, openings 152*b*, 154*b*, 156*b* in first outer panel 122*b* and openings 158*b*, 160*b* and 162*b* in second outer panel 124*b* have substantially the same dimensions including a length 161*b* and a height 163*b*.

There are also three openings 164*b*, 166*b* and 168*b* in inner panel 126*b* as shown in phantom lines in FIG. 16. Openings 164*b*, 166*b* and 168*b* all have substantially the same length 171*b* and height 173*b* and length 171*b* is greater than length 161*b* and height 173*b* is greater than height 163*b*. This means that the perimeter of opening 164*b* in inner panel 126*b* is recessed from the aligned perimeters of openings 152*b* and 158*b*, the perimeter of opening 166*b* in inner panel 126*b* is recessed from the aligned perimeters of openings 154*b* and 160*b* and the perimeter of opening 168*b* in inner panel 126*b* is recessed from the aligned perimeters of openings 156*b* and 162*b*. In other embodiments, at least a bottom of opening 164*b* in inner panel 126*b* is recessed from bottoms of openings 152*b* and 158*b*, a bottom of opening 166*b* in inner panel 126*b* is recessed from bottoms of openings 154*b* and 160*b* and a bottom of opening 168*b* in inner panel 126*b* is recessed from bottoms of openings 156*b* and 162*b*.

Figure 18:
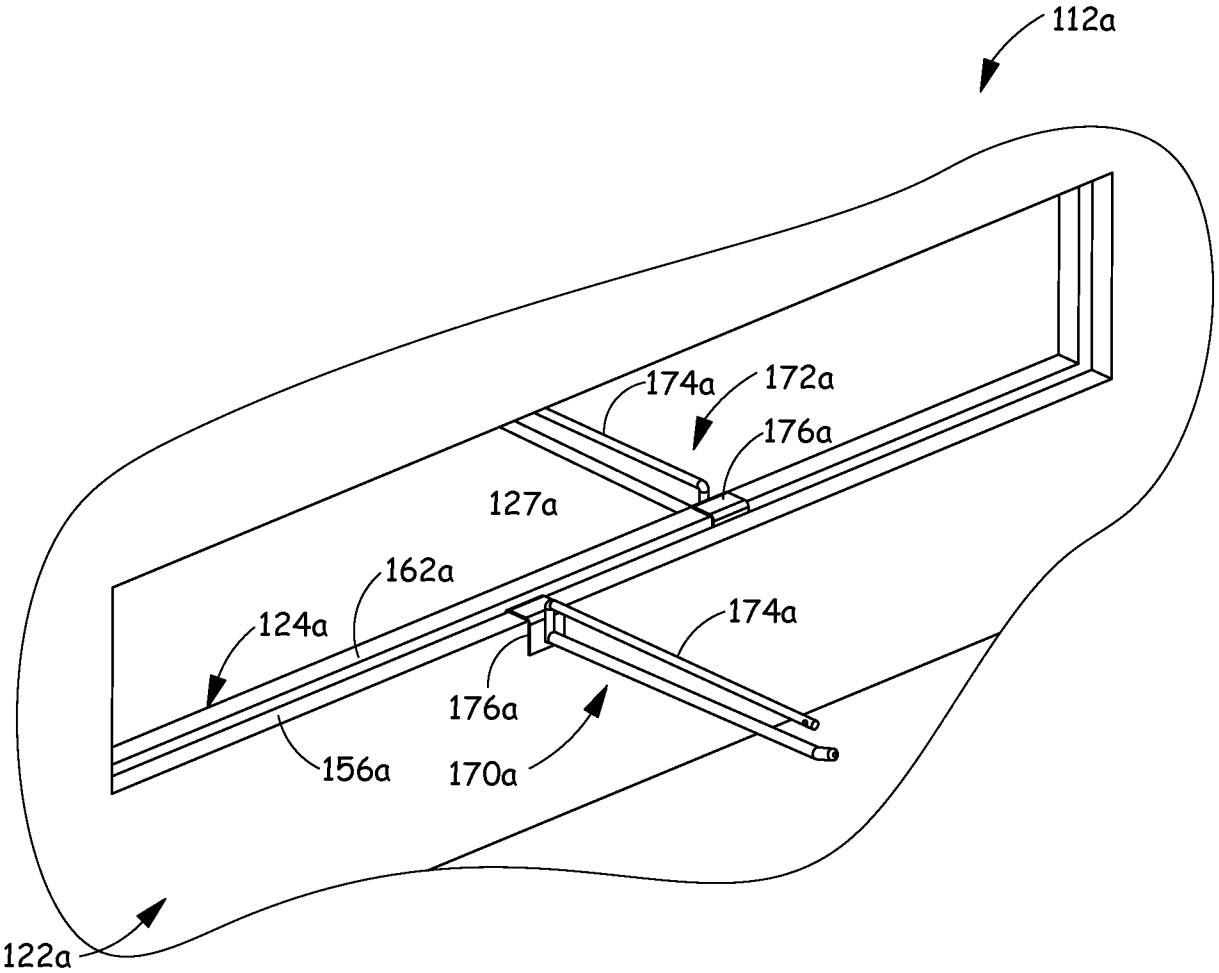
FIG. 18 is an enlarged view of an opening in left angled wall of FIG. 13 with peg hooks mounted thereon.

FIG. 18 is an enlarged view of an opening in left angled wall 112*a* of FIG. 13 with peg hooks mounted thereon. In particular, FIG. 18 is an enlarged view of opening 156*a* in first outer panel 122*a* and opening 162*a* in second outer panel 124*a* with opening 168*a* (hidden from view) in inner panel 126*a* (hidden from view) being recessed from the aligned openings 156*a* and 162*a*. Because of recessed opening 168*a*, peg hooks 170*a* and 172*a* are mounted to left angled wall 112*a*. Each peg hook 170*a* and 172*a* includes a stem 174*a* for hanging product for display and an overhanging member 176*a*. Overhanging member 176*a* of either peg hook 170*a* or 172*a* slides over the bottom of the perimeter of opening 156*a* in first outer panel 122*a* or the bottom of the perimeter of opening 162*a* in second outer panel 124*a* such that a portion of overhang member 176*a* extends into the recess below the bottoms of openings 156*a* and 162*a* and a bove the bottom of opening 168*a*. This is made possible by opening 168*a* being recessed from opening 156*a* in first outer panel 122*a* and opening 168*a* being recessed from opening 162*a* in second outer panel 124*a*. Such mounting of peg hooks to all openings in left angled wall 112*a* and all openings in right angled wall 112*b* are possible and allow customers to see product hanging on peg hooks on opposing walls through the openings.

With reference back to FIGS. 15 and 16, top end 127*a* of inner panel 126*a* in left angled wall 112*a* includes middle portion 135*a* and top end 127*b* of inner panel 126*b* in right angled wall 112*b* includes middle portion 135*b*. The middle portions 135*a* and 135*b* are located respective distances 133*a* and 133*b* below two upper end portions 137*a* and 139*a* and 137*b* and 139*b* of respective top ends 127*a* and 127*b*. Not only can peg hooks having stems and overhanging members, such as peg hooks 170*a* and 174*a*, be mounted to the perimeters of the openings in first outer panel 122*a* and second outer panel 124*a* of left angled wall 112*a* and first outer panel 122*b* and second outer panel 124*b* of right angled wall 112*b*, but peg hooks 170*a* and 174*a* can be mounted to top end 123*a* of first outer panel 122*a*, top end 123*b* of first outer panel 122*b*, top end 125*a* of second outer panel 124*a* and top end 125*b* of second outer panel 124*b* because middle portion 135*a* of top end 127*a* is recessed from top ends 123*a* and 125*a* and middle portion 135*b* of top end 127*b* is recessed from tops ends 123*b* and 125*b*.

Figure 19:
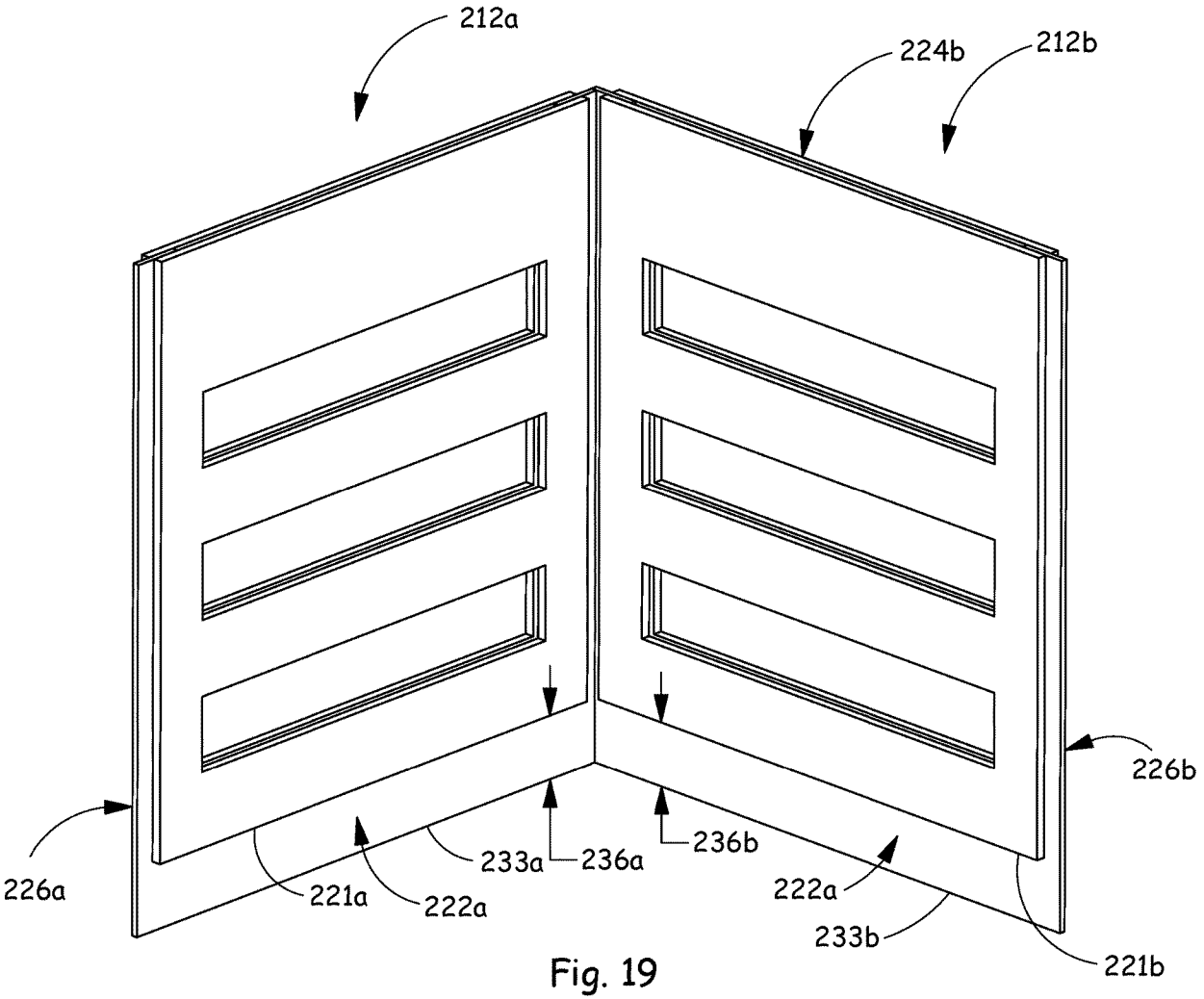
FIG. 19 is a first perspective view of two angled walls of the modular display unit illustrated in FIGS. 7-12.
Figure 20:
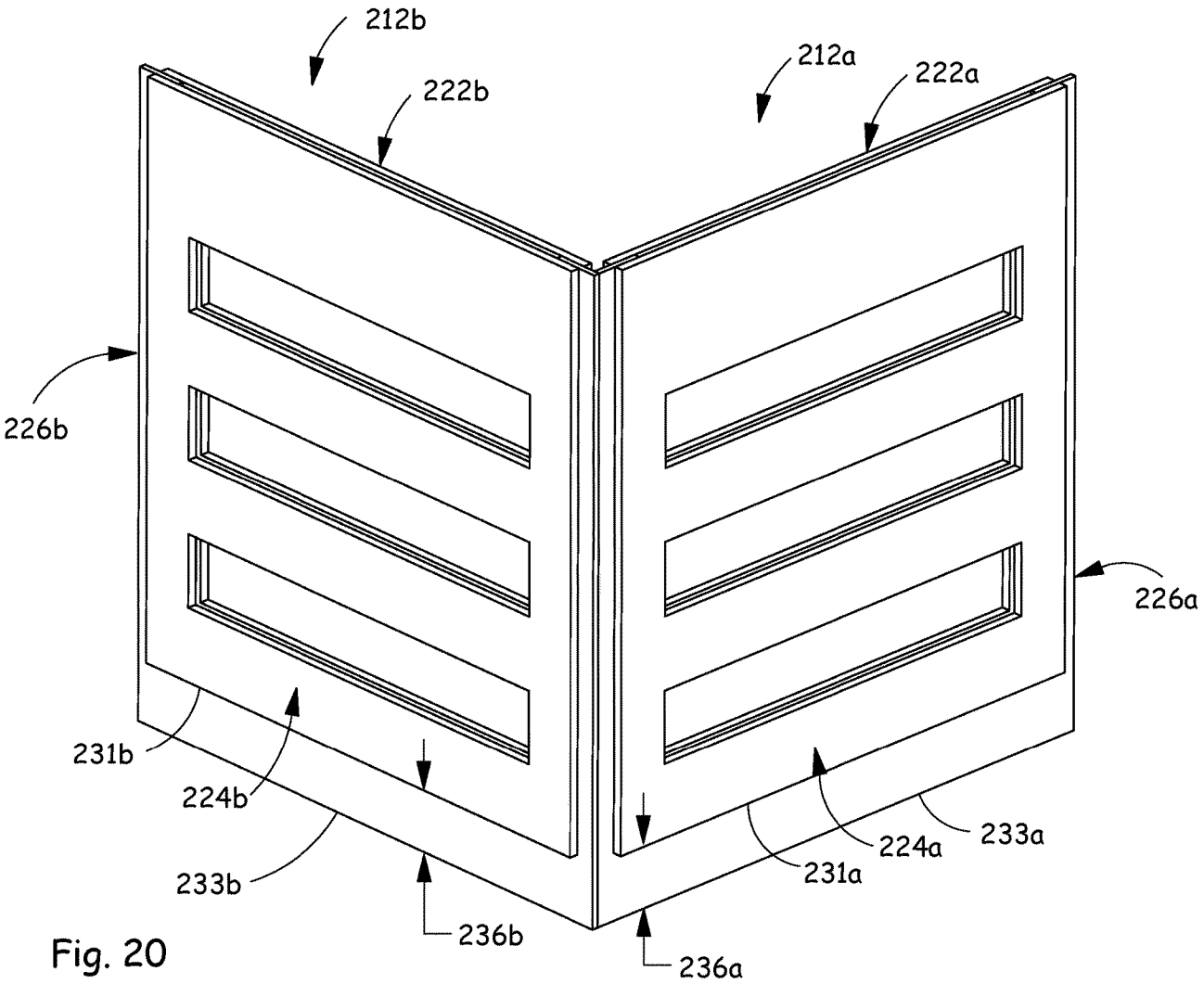
FIG. 20 is a second perspective view of the two angled walls of the modular display unit illustrated in FIGS. 7-12.
Figure 22:
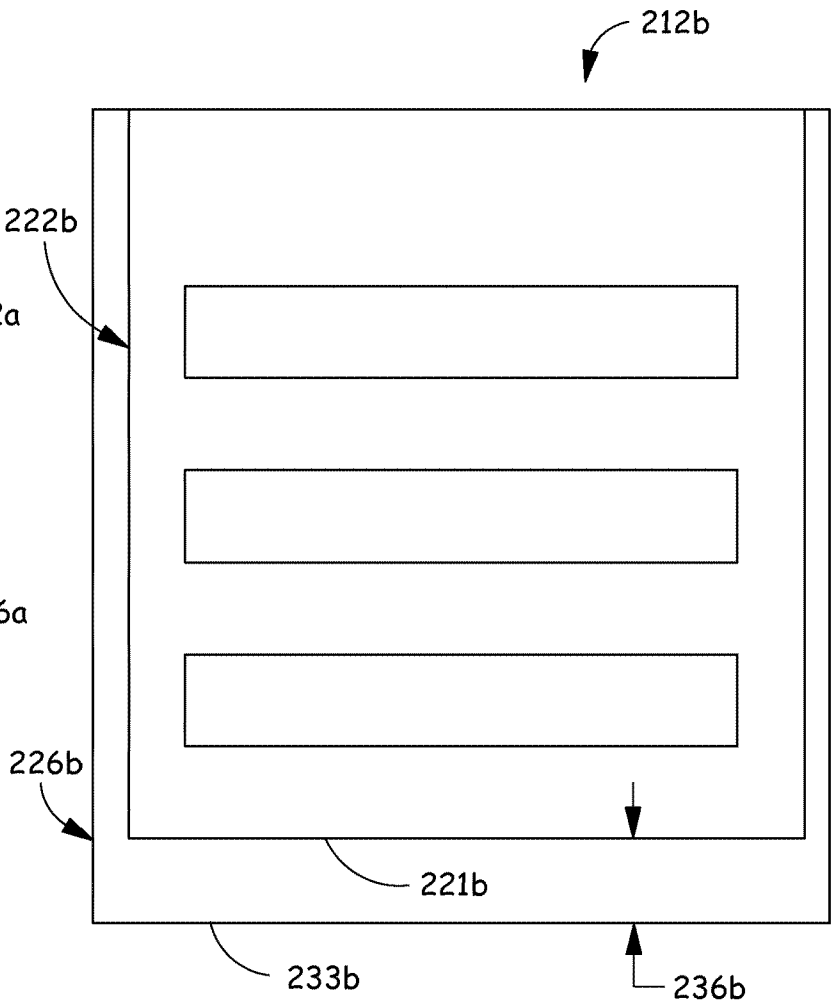
FIG. 22 is a plan view of the right angled wall of FIGS. 19 and 20.
Figure 21:
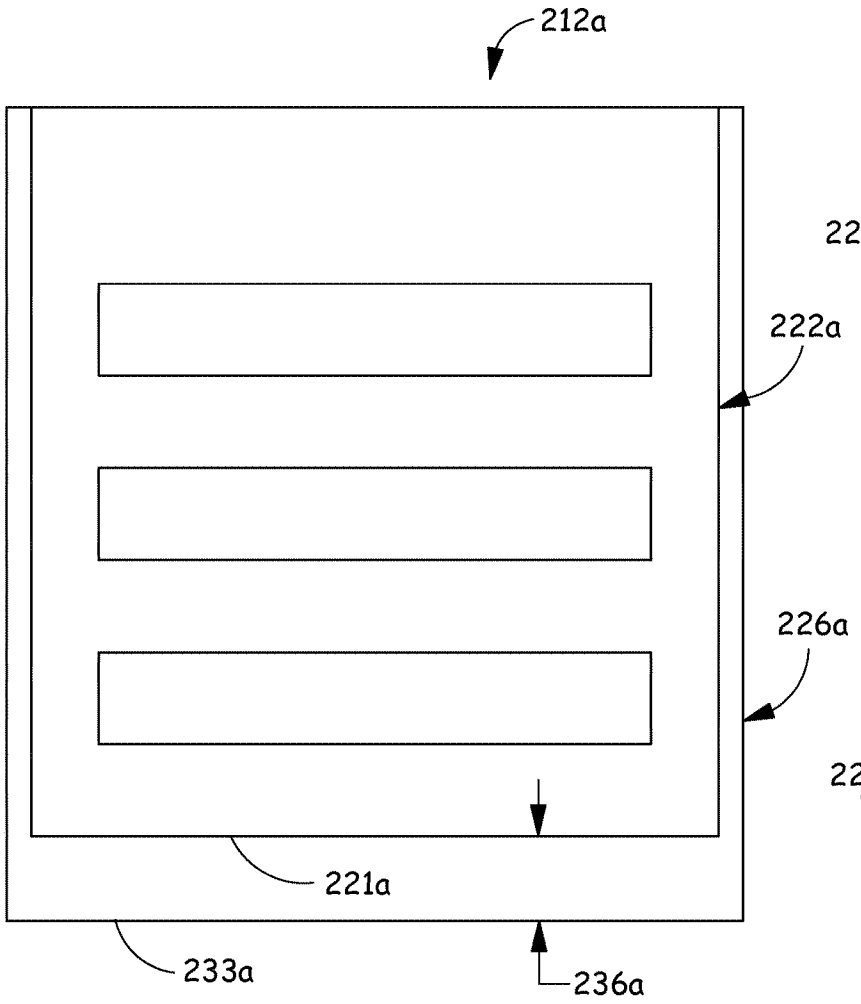
FIG. 21 is a plan view of the left angled wall of FIGS. 19 and 20.

FIG. 19 is a first perspective view of two angled walls 212*a* and 212*b* of modular display unit 200 and FIG. 20 is a second perspective view of FIG. 19. FIG. 21 is a plan view of left angled wall 212*a* and FIG. 22 is a plan view of right angled wall 212*b*. Two angled walls 212*a* and 212*b* of display unit 200 are similar to two angled walls 112*a* and 112*b* of display unit 100 except that two angled walls 212*a* and 212*b* are supported by table 202 rather than base 102. Therefore, all components of two angled walls 212*a* and 212*b*, such as first outer panels 222*a* and 222*b*, second outer panels 224*a* and 224*b* and inner panels 226*a* and 226*b* including their openings have the same relative arrangements and dimensions as two angled walls 112*a* and 112*b*. The difference between two angled walls 112*a* and 112*b* and two angled walls 212*a* and 212*b* is in distances 236*a* and 236*b* rather than distances 136*a* and 136*b*. Distance 236*a* is the distance between bottom end 221*a* of first outer panel 222*a* and bottom end 233*a* of inner panel 226*a* and also the distance between bottom end 231*a* of second outer panel 224*a* and bottom end 233*a* of inner panel 226*a*. Distance 236*b* is the distance between bottom end 221*b* of first outer panel 222*b* and bottom end 233*b* of inner panel 226*b* and also the distance between bottom end 231*b* of second outer panel 224*b* and bottom end 233*b* of inner panel 226*b*. In particular, distance 236*a* is less than distance 136*a* and distance 236*b* is less than distance 136*b*, where distances 136*a* and 136*b* are substantially the same and distances 236*a* and 236*b* are substantially the same.

Figure 23:
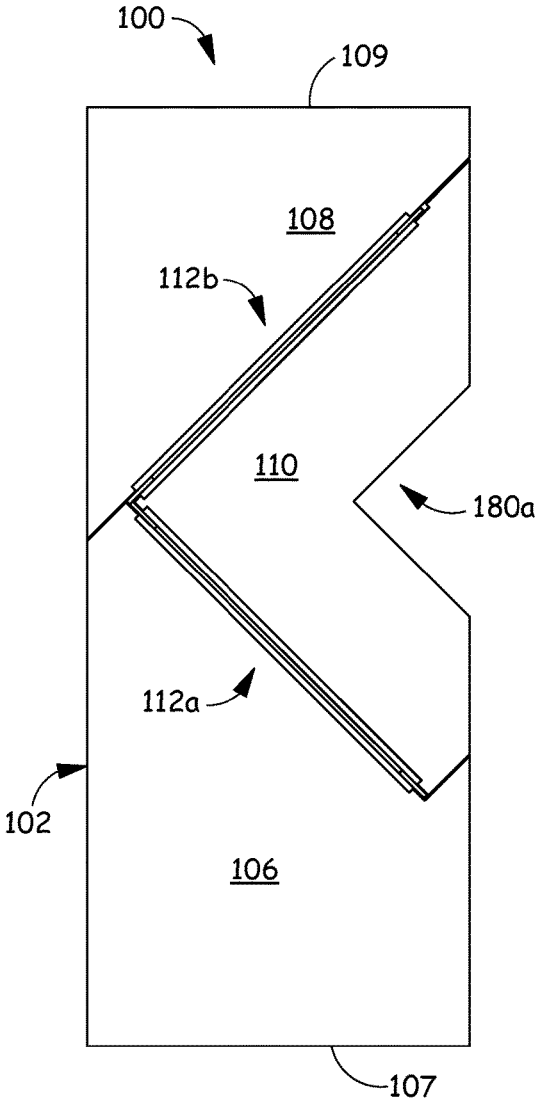
FIG. 23 is a top view of the modular display unit in FIG. 1 illustrating multiple base components and two angled walls but with tables, cubbies and shelving removed for purposes of clarity.

FIG. 23 is a top view of modular display unit 100 illustrating a plurality of adjacent modular base components 106, 108 and 110 of platform 102 and angled walls 112*a* and 112*b* but with base component 104, tables, cubbies and shelving removed for purposes of clarity. Base components 106, 108 and 110 are modular in that base components 106, 108 and 110 are standardized components for the purpose of ease of construction and ease of arrangement depending on how many walls are desired in any given display unit. In particular, base component 106 is a first endcap base component 106, base component 108 is a second endcap base component 108 and base component 110 is a middle v-shaped base component 110 located between endcap base components 106 and 108. This means that on either side of one or more middle v-shaped bases 110, depending on the amount of angled walls that are desired, there are endcap bases. Together base components 106, 108 and 110 occupy a space that is defined between outer end 107 of first endcap base component 106 and outer end 109 of second endcap base component 108. Outer ends 107 and 109 of respective endcap base components 106 and 108 are substantially parallel to each other.

In FIG. 23, modular display unit 100 includes two angled walls 112*a* and 112*b* as illustrated in FIGS. 1-7 that extend upwardly from the plurality of adjacent modular base components 106, 108 and 110. Each angled wall 112*a* and 112*b* is oriented at an angle relative to the substantially parallel outer ends 107 and 109 of endcaps 106 and 108 and angled walls 112*a* and 112*b* are substantially perpendicular to each other. As illustrated, a thickness of the inner panel of angled wall 112*a* abuts the planar surface of the inner panel of angled wall 112*b*. Therefore, an end of the inner panel of angled wall 112*b* that abuts an end of angled wall 112*a* extends for a distance from the outer panels that is greater than a distance the corresponding end of the inner panel of angled wall 112*a* extends from the outer panels.

Figure 24:
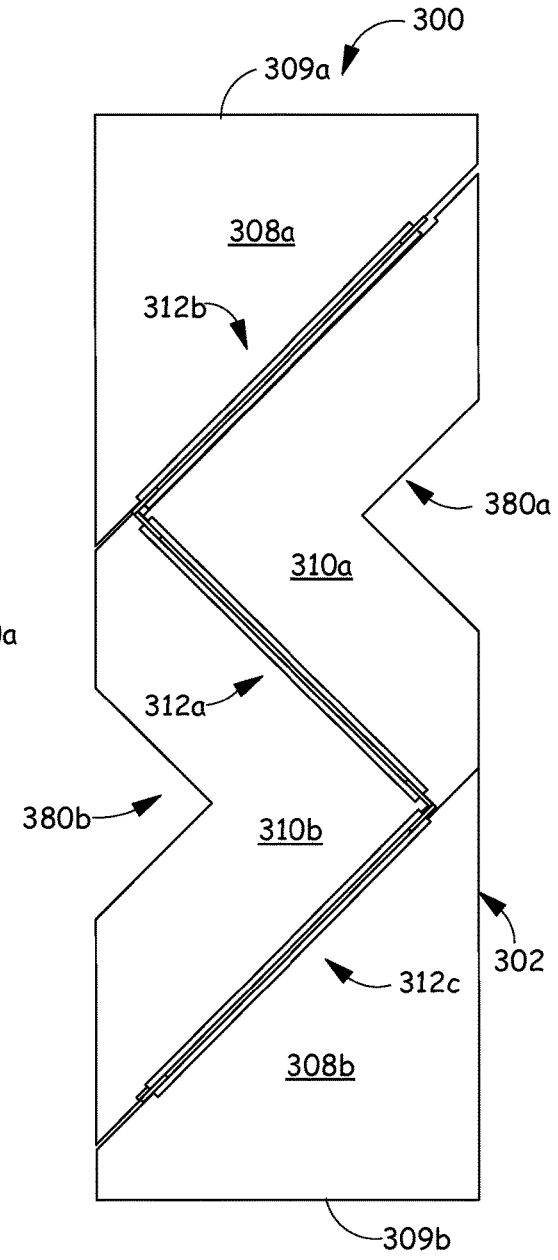
FIG. 24 is a top view of a modular display unit according to another embodiment and illustrating multiple base components and a set of three angled walls with tables, cubbies and shelving removed for purposes of clarity.

FIG. 24 is a top view of modular display unit 300 according to another embodiment and illustrating a plurality of adjacent modular base components 308*a*, 308*b*, 310*a* and 310*b* of platform 302 and a set of three angled walls 312*a*, 312*b* and 312*c* with tables, cubbies and shelving removed for purposes of clarity. In this embodiment, in order to accommodate three angled walls 312*a*, 312*b* and 312*c* rather than the two angled walls 112*a* and 112*b* of FIG. 23, four base components are needed. A first endcap base component, such as a first endcap base component 106 shown in FIG. 23, is eliminated and two substantially identical second endcap bases 308*a* and 308*b* are used at each end of display unit 300 with first endcap base 308*a* being rotated relative to second endcap base 308*b*. Between the two second endcap bases 308*a* and 308*b* are two v-shaped bases 310*a* and 310*b*. First v-shaped base 310*a* is located adjacent to second endcap base 308*a* and accommodates first and second angled walls 312*a* and 312*b*. Second v-shaped base 310*b* is located adjacent to and between first v-shaped base 310*a* and second endcap base 308*b* and accommodates first and third angled walls 312*a* and 312*c*. Together base components 308*a*, 308*b*, 310*a* and 310*b* occupy a space defined between outer end 309*a* of second endcap base component 308*a* and outer end 309*b* of second endcap base component 308*b*. Outer ends 309*a* and 309*b* of respective endcap base components 308*a* and 308*b* are substantially parallel to each other.

Therefore, each angled wall 312*a*, 312*b* and 312*c* is oriented at an angle relative to the substantially parallel outer ends of endcaps 308*a* and 308*b*, and adjacent walls 312*a*, 312*b* and 312*c* are substantially perpendicular to each adjacent wall. As illustrated, angled wall 312*a* is similar to angle wall 112*a* and angled wall 312*b* is similar to angled wall 112*b*. An end of the inner panel of angled wall 312*c* that abuts an end of angled wall 312*a* extends for a distance from the outer panels that is greater than a distance the corresponding end of the inner panel of angled wall 312*a* extends from the outer panels.

Figure 25:
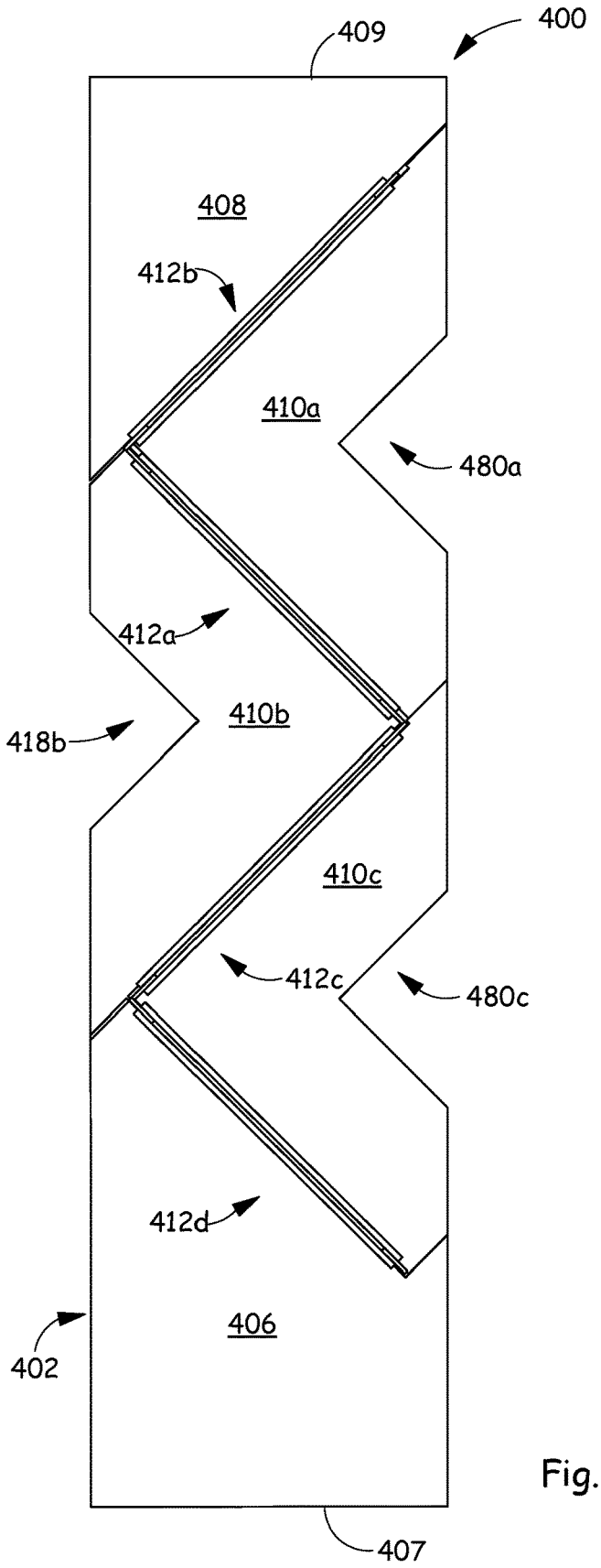
FIG. 25 is a top view of a modular display unit according to yet another embodiment and illustrating multiple base components and a set of four angled walls with tables, cubbies and shelving removed for purposes of clarity.

FIG. 25 is a top view of modular display unit 400 according to yet another embodiment and illustrating a plurality of adjacent modular base components 406, 408, 410*a*, 410*b* and 410*c* and a set of four angled walls 412*a*, 412*b*, 412*c*, 412*d* with tables, cubbies and shelving removed for purposes of clarity. In this embodiment, in order to accommodate four angled walls 412*a*, 412*b*, 412*c* and 412*d* rather than the adjacent angled walls 312*a*, 312*b* and 312*c* of FIG. 24, five base components are needed. First endcap base component 406 and second endcap base component 408 are used at each end of the display unit. Between the two endcap base components 406 and 408 are three v-shaped base components 410*a*, 410*b* and 410*c*. First v-shaped base 410*a* is located adjacent to second endcap base component 408 and accommodates first and second walls 412*a* and 412*b*. Second v-shaped base component 410*b* is located between first v-shaped base component 410*a* and third v-shaped base component 410*c* and accommodates first and third angled walls 412*a* and 412*c*. Third v-shaped base component 410*c* is located adjacent to first endcap base component 406 and accommodates third and fourth angled walls 412*c* and 412*d*. Together base components 406, 408, 410*a*, 410*b* and 410*c* occupy a space defined between outer end 407 of first endcap base component 406 and outer end 409 of second endcap base component 408. Outer ends 407 and 409 of respective endcap base components 406 and 408 are substantially parallel to each other.

Therefore, each angled wall 412*a*, 412*b*, 412*c* and 412*d* is oriented at an angle relative to the substantially parallel ends 407 and 409 of endcaps 406 and 408 and angled walls 412*a*, 412*b*, 412*c* and 412*d* are substantially perpendicular to each adjacent wall. As illustrated, angled wall 412*a* is similar to angle wall 312*a*, angled wall 412*b* is similar to angled wall 312*b* and angled wall 412*c* is similar to angled wall 312*c*. An end of the inner panel of angled wall 412*d* that abuts an end of angled wall 412*c* extends for a distance from the outer panels that is greater than a distance the corresponding end of the inner panel of angled wall 412*c* extends from the outer panels.

As illustrated in FIGS. 23, 24 and 25, each v-shaped base component includes a v-shaped notch. Display unit 100 includes a single v-shaped notch 180*a* because display unit 100 includes only a single v-shaped base component 110. Display unit 300 includes two v-shaped notches 380*a* and 380*b* because display unit 300 includes two v-shaped base components 310*a* and 310*b*. Display unit 400 includes three v-shaped notches 480*a*, 480*b* and 480*c* because display unit 400 includes three v-shaped base components 410*a*, 410*b* and 410*c*. These v-shaped notches allow the customer to step into display unit 100 from the aisle to get a closer look at merchandise and keep viewing merchandise while allowing another customer or another cart to pass by in the aisle. In addition, the number of v-shaped base components in each embodiment of base-type modular display units 100, 300 and 400 is one less than a number of angled walls in each embodiment of base-type modular display units 100, 300 and 400. Of course, other embodiments are possible with the number of angled walls exceeding four and the number of v-shaped base components exceeding three.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A modular display unit comprising:

a plurality of adjacent modular base components fitted together to occupy a rectangular footprint and comprising:

a first endcap base component having at least four sides including an outer endcap end and an opposing inside end;

a second endcap base component having at least four sides including an outer endcap end and an opposing inside end, wherein the outer endcap end of the second endcap base component is parallel with the outer endcap end of the first endcap base component;

at least one center base component located between the first and second endcap base components and having at least six sides, wherein first and second sides of the at least six sided base component are adjacent and angled relative to each other to form a v-shape and wherein the first side of the v-shape abuts the inner end of the first endcap base component at a seam; and at least two angled walls that extend upwardly from the plurality of modular base components and are adjacent and angled relative to each other in a v-shape, wherein one of the at least two angled walls aligns with the seam formed by abutting the inner end of the first endcap base component with the first side of the v-shape of the at least six sided base component; and wherein a number of center base components in the modular display unit is one less than a number of the at least two angled walls.

2. The modular display unit of claim 1, wherein the modular display unit comprises two angled walls, a first endcap base component, a second endcap base component and one center base component positioned in between the first and second endcap base components, the first and second endcap base components having a quantity of sides different from each other.

3. The modular display unit of claim 1, wherein the modular display unit comprises three angled walls, a first endcap base component, a second endcap base component and two center base components positioned in between the first and second endcap base components, the first base component having a quantity of sides identical to each other.

4. The modular display unit of claim 1, wherein the modular display unit comprises four angled walls, a first endcap base component, a second endcap base component, and three center base components positioned in between the first and second endcap base components, the first and second endcap base components having a quantity of sides different from each other.

5. The modular display unit of claim 1, wherein each angled wall comprises a first outer panel, a second outer panel and an inner panel positioned between the first and the second outer panels, wherein the first outer panel and the second outer panel are substantially identical.

6. The modular display unit of claim 5, wherein a top end of the first and the second outer panels align with at least a portion of a top end of inner panel while bottom ends of the first and second outer panels are spaced apart from a bottom end of inner panel and side ends of the first and second outer panel are spaced apart from side ends of the inner panel.

7. The modular display unit of claim 5, wherein each of the first outer panel, second outer panel and inner panel comprise openings that are at least partially in alignment with each other so as to allow the customer to see through the angled walls to an opposing side of the modular display unit.

8. The modular display unit of claim 7, wherein a number of openings in the first outer panel, a number of openings in the second outer panel and a number of openings in the inner panel correspond with each other, wherein the openings in the first outer panel and the second outer panel are aligned with each other and include the same lengths and widths and wherein the openings in the inner panel are aligned with the openings in the first outer panel and second outer panel but include lengths and widths that are greater than the lengths and widths of the first outer panel and the second outer panel so that a bottom of each opening in the inner panel is recessed from a bottom of each opening in the first and second outer panels.

9. The modular display unit of claim 8, further comprising at least one display hook having a stem for supporting product and an overhanging member that slides over the bottom of each opening in first outer panel or the bottom each opening in the second outer panel.

10. A modular display unit comprising:

a platform that occupies a rectangular footprint and includes opposing ends being substantially parallel to each other; and at least one wall that extends upwardly from the platform, wherein each wall comprises:

a first outer panel including at least one opening having a length and a width;

a second outer panel having at least one opening that aligns with the at least one opening in the first outer panel and having a length and a width that is the same as the length and the width of the at least one opening in the first outer panel; and an inner panel positioned between the first outer panel and the second outer panel and including at least one opening that aligns with the at least one opening in the first outer panel and the at least one opening in the second outer panel but has a length and a width that is greater than the lengths and the widths of the at least one opening in the first outer panel and the at least one opening in the second outer panel so that at least a bottom of the at least one opening in the inner panel is recessed from a bottom of the at least one opening in the first outer panel and a bottom of the at least one opening in the second outer panel.

11. The modular display unit of claim 10, further comprising at least one display hook having a stem for supporting product and an overhanging member that slides over one of the bottom of the at least one opening in the first outer panel and the bottom of the at least one opening in the second outer panel.

12. The modular display unit of claim 10, wherein the first outer panel comprises a planar top end, a bottom end and a pair of side ends, wherein the second outer panel comprises a planar top end, a bottom end and a pair of side ends, and wherein the inner panel comprises a top end, a bottom end and a pair of side ends, the top end of the inner panel including a pair of planar upper portions and a planar middle portion located between the pair of planar upper portions that is recessed from the pair of planar upper portions and the planar top ends of the first outer panel and the second outer panel aligning with the pair of planar upper portions of the top end of the inner panel.

13. The modular display unit of claim 10, wherein the at least one opening in the first outer panel, the second outer panel and the inner panel comprise a plurality of openings, wherein a number of openings in the first outer panel, a number of openings in the second outer panel and a number of openings in the inner panel correspond with each other.

14. The modular display unit of claim 13, wherein the at least one wall comprises at least two angled walls, each angled wall being oriented at an angled relative to the substantially parallel ends of the platform and having a side that is adjacent and oriented substantially perpendicularly to a side of the other angled wall.

15. The modular display unit of claim 13, wherein the platform comprises a plurality of adjacent base components including two endcap base components and at least one v-shaped based component.

16. The modular display unit of claim 13, wherein the platform comprises a table.

17. The modular display unit of claim 10, wherein top end of the first and the second outer panels align with at least a portion of a top end of the inner panel while bottoms ends of the first and second outer panels are spaced apart from a bottom end of the inner panel and side ends of the first and second outer panels are spaced apart from side ends of the inner panel.

18. A modular display unit comprising:

a platform that occupies a rectangular footprint and includes opposing ends being substantially parallel to each other; and at least one wall that extends upwardly from the platform, wherein each wall comprises:

a first outer panel including a planar top end, a bottom end and first and second opposing side ends;

a second outer panel having a planar top end, a bottom end and first and second opposing side ends; and an inner panel positioned between the first outer panel and the second outer panel and including a top, a bottom end and first and second opposing side ends, wherein the top includes a planar middle portion located between and having an edge recessed from edges of a pair of planar upper portions;

wherein the planar top ends of the first outer panel and the second outer panel are in alignment with edges of the pair of planar upper portions of the top of the inner panel and not in alignment with the edge of the planar middle portion of the top of the inner panel.

19. The modular display unit of claim 1, further comprising at least one display hook having a stem for supporting product and an overhanging member that slides over the top end of one of the first outer panel and the second outer panel in an area along where the middle portion of the inner panel is located.

20. The modular display unit of claim 18, wherein the first outer panel comprises at least one opening having a length and a width, wherein the second outer panel comprises at least one opening that aligns with the at least one opening in the first outer panel and having a length and a width that is the same as the length and the width of the at least one opening in the first outer panel, and wherein the inner panel comprises at least one opening that aligns with the at least one opening in the first outer panel and the at least one opening in the second outer panel but has a length and a width that is greater than the lengths and the widths of that least one opening in the first outer panel and the at least one opening in the second outer panel so that at least a bottom of the at least one opening in the inner panel is recessed from a bottom of the at least one opening in the first outer panel and a bottom of the at least one opening in the second outer panel.

* * * * *